US010605131B2

(12) United States Patent
Cecur et al.

(10) Patent No.: US 10,605,131 B2
(45) **Date of Patent: *Mar. 31, 2020**

(54) ROCKER ARM ASSEMBLY FOR ENGINE BRAKING

(71) Applicant: Eaton SRL, Turin (IT)

(72) Inventors: Majo Cecur, Rivarolo Canavese (IT); Marco Alessandria, Trana (IT); Nicola Andrisani, Cumiana (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 89 days.

This patent is subject to a terminal disclaimer.

(21) Appl. No.: 15/512,151

(22) PCT Filed: Sep. 18, 2014

(86) PCT No.: PCT/EP2014/069940

§ 371 (c)(1),
(2) Date: Mar. 17, 2017

(87) PCT Pub. No.: WO2016/041600

PCT Pub. Date: Mar. 24, 2016

(65) Prior Publication Data

US 2017/0276035 A1 Sep. 28, 2017

(51) Int. Cl.
*F02D 1/00* (2006.01)
*F01L 13/06* (2006.01)
(Continued)

(52) U.S. Cl.
CPC ..... *F01L 13/06* (2013.01); *F01L 1/181* (2013.01); *F01L 1/2416* (2013.01);
(Continued)

(58) Field of Classification Search
CPC . F01L 13/06; F01L 13/065; F01L 9/02; F01L 9/021; F01L 9/025; F01L 1/18; F02D 9/06; F02D 13/04
(Continued)

(56) References Cited

U.S. PATENT DOCUMENTS 5,890,469 A † 4/1999 Hakansson
6,386,160 B1 † 5/2002 Meneely
(Continued)

FOREIGN PATENT DOCUMENTS

JP 2011149398 A 8/2011
WO WO 0146578 A1 6/2001

OTHER PUBLICATIONS

U.S. Appl. No. 16/244,135, filed Jan. 10, 2019.

*Primary Examiner* — John Kwon
(74) *Attorney, Agent, or Firm* — Leydig, Voit & Mayer, Ltd.

(57) ABSTRACT

An exhaust valve rocker arm assembly operable in a combustion engine mode and an engine braking mode can include a rocker shaft and a rocker arm. The rocker shaft can define a pressurized oil supply conduit. The rocker arm can receive the rocker shaft and is configured to rotate around the rocker shaft. The rocker arm can have an oil supply passage defined therein. A valve bridge can engage a first exhaust valve and a second exhaust valve. A hydraulic lash adjuster assembly can include first and second plunger bodies, the first plunger body can engage the valve bridge. A pressure relief valve assembly can be configured to selectively release oil from the hydraulic lash adjuster assembly.

10 Claims, 21 Drawing Sheets

(51) Int. Cl.
*F01L 1/18* (2006.01)
*F01L 1/24* (2006.01)
*F02D 13/04* (2006.01)

(52) U.S. Cl.
CPC ..... *F01L 13/065* (2013.01); *F01L 1/18* (2013.01); *F01L 1/24* (2013.01); *F01L 2760/004* (2013.01); *F02D 13/04* (2013.01)

(58) Field of Classification Search
USPC ..... 123/320, 90.1, 90.25, 90.39
See application file for complete search history.

(56) References Cited

U.S. PATENT DOCUMENTS

| | | | | |
|---|---|---|---|---|
| 6,694,933 | B1 † | 2/2004 | Lester | |
| 8,065,987 | B2 † | 11/2011 | Yang | |
| 2002/0134337 | A1 * | 9/2002 | Uchida | F01L 1/34 123/90.31 |
| 2002/0134341 | A1 * | 9/2002 | Uchida | F02F 1/242 123/193.5 |
| 2009/0266317 | A1 | 10/2009 | Meacock | |
| 2011/0220052 | A1 † | 9/2011 | Sailer | |
| 2017/0175597 | A1 * | 6/2017 | Cecur | F01L 1/16 |
| 2018/0045086 | A1 * | 2/2018 | Cecur | F01L 1/245 |
| 2018/0073401 | A1 * | 3/2018 | Andrisani | F01L 13/06 |
| 2018/0087412 | A1 * | 3/2018 | Andrisani | F01L 13/06 |
| 2018/0298795 | A1 * | 10/2018 | Cecur | F01L 13/0031 |

* cited by examiner
† cited by third party

ROCKER ARM ASSEMBLY FOR ENGINE BRAKING

CROSS-REFERENCE TO RELATED APPLICATIONS

This application is a U.S. national stage application under 35 U.S.C. § 371 of International Application No. PCT/EP2014/069940, filed on Sep. 18, 2014. The International Application was published in English on Mar. 24, 2016, as WO 2016/041600 A1 under PCT Article 21(2).

FIELD

The present disclosure relates generally to a rocker arm assembly for use in a valve train assembly and more particularly to a rocker arm assembly that provides a compression brake function.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor, which slows the vehicle.

In a typical valve train assembly used with a compression engine brake, the exhaust valve is actuated by a rocker arm, which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An aspect of the invention provides an exhaust valve rocker arm assembly operable in a combustion engine mode and an engine braking mode, the exhaust valve rocker arm assembly comprising: a rocker shaft that defines a pressurized oil supply conduit; a rocker arm configured to receive the rocker shaft and configured to rotate around the rocker shaft, the rocker arm including an oil supply passage defined therein; a valve bridge configured to engage a first exhaust valve at a spherical elephant foot and a second exhaust valve at a cylindrical elephant foot; a hydraulic lash adjuster assembly disposed on the rocker arm including a first plunger body movable between a first position and a second position, wherein in the first position, the first plunger body extends rigidly for cooperative engagement with the valve bridge; and a pressure relief valve assembly disposed on the rocker arm and configured to selectively release oil from the hydraulic lash adjuster assembly, wherein, in the engine braking mode, pressurized oil is communicated through the pressurized oil supply conduit, through the rocker arm oil supply passage, and against the actuator, such that the first plunger occupies the first position and acts on the valve bridge during rotation of the rocker arm to a first angle, opening the first exhaust valve a predetermined distance while the second exhaust valve remains closed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
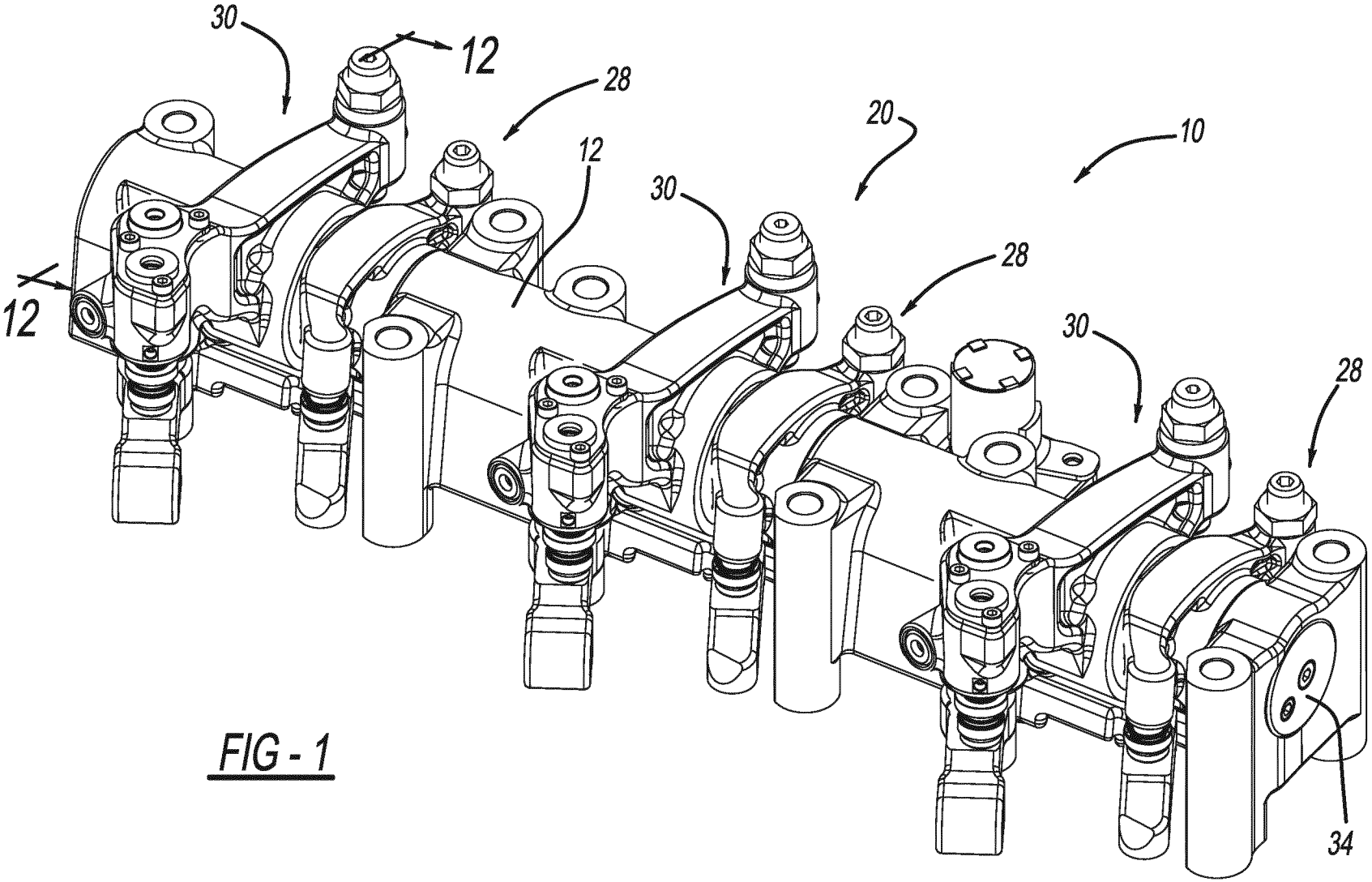
FIG. 1 a perspective view of a partial valve train assembly incorporating a rocker arm assembly including an exhaust valve rocker arm assembly for use with compression engine braking and constructed in accordance to one example of the present disclosure.

An exhaust valve rocker arm assembly operable in a combustion engine mode and an engine braking mode can include a rocker shaft and a rocker arm. The rocker shaft can define a pressurized oil supply conduit. The rocker arm can receive the rocker shaft and is configured to rotate around the rocker shaft. The rocker arm can have an oil supply passage defined therein. A valve bridge can engage a first exhaust valve and a second exhaust valve. A hydraulic lash adjuster assembly can be disposed on the rocker arm having a first plunger body movable between a first position and a second position. In the first position, the first plunger body extends rigidly for cooperative engagement with the valve bridge. A pressure relief valve assembly can be disposed on the rocker arm and be configured to selectively release oil from the hydraulic lash adjuster assembly. In the engine braking mode, pressurized oil is communicated through the pressurized oil supply conduit, through the rocker arm oil supply passage and against the actuator such that the first plunger occupies the first position and acts on the valve bridge during rotation of the rocker arm to a first angle opening the first valve a predetermined distance while the second valve remains closed.

According to additional features, the pressure relief valve assembly can comprise a pressure relief valve biasing member, a plunger and a support ring. A check valve can be disposed on the rocker arm and have an actuator that selectively releases pressure in the hydraulic lash adjuster. The actuator can further comprise a needle having a longitudinal pin portion and a disk portion.

According to other features, the exhaust valve rocker arm assembly can further comprise an oil discharge circuit. The oil discharge circuit can be configured to selectively depressurize oil under the disk portion of the needle. A spigot can be disposed on the rocker arm. In the engine braking mode, subsequent to the opening of the first valve the predetermined distance, further rotation of the rocker arm causes the spigot to move the valve bridge and open the second valve while further opening the first valve.

According to additional features, the oil discharge circuit can be collectively defined by a first connecting passage and an outlet passage defined in the rocker arm and a pass-through channel defined in the spigot. The first connecting passage can connect a bore defined in the rocker arm that receives the disk portion with a spigot receiving passage that receives the spigot. The spigot can be configured to translate relative to the rocker arm along the spigot receiving passage. A predetermined rotation of the rocker arm will align the first connecting passage, the pass-through channel and the outlet passage and depressurize oil from under the disk portion of the needle.

According to still other features, the hydraulic lash adjuster assembly can further comprise a second plunger body that is at least partially received by the first plunger body. The second plunger body can define a valve seat. The check valve can be disposed between the first and second plunger bodies. The check valve can further comprise a check ball that selectively seats against the valve seat on the second plunger body.

An exhaust valve rocker arm assembly operable in a combustion engine mode and an engine braking mode according to another example of the present disclosure includes a rocker shaft that defines a pressurized oil supply conduit. A rocker arm can receive the rocker shaft and be configured to rotate around the rocker shaft. The rocker arm can have an oil supply passage defined therein. A valve bridge can engage a first exhaust valve and a second exhaust valve. A first plunger body can be movable between a first position and a second position. In the first position the first plunger body extends rigidly for cooperative engagement with the valve bridge. A check valve can be disposed on the rocker arm and have an actuator that selectively releases pressure acting on the first plunger body. An oil discharge circuit can be configured to selectively depressurize oil under the disk portion of the actuator. In the engine braking mode the rocker arm is configured to rotate (i) a first predetermined angle wherein pressurized oil is communicated through the pressurized oil supply conduit, through the rocker arm oil supply passage and against the actuator. The first plunger occupies the first position and acts on the valve bridge opening the first valve a predetermined distance while the second valve remains closed. The rocker arm continues to rotate (ii) a second predetermined angle wherein the oil discharge circuit opens releasing oil pressure from under the disk portion of the actuator, and (iii) a third predetermined angle wherein the rocker arm oil supply passage disconnects from the pressurized oil circuit.

According to additional features, the exhaust valve rocker arm assembly can further comprise a pressure relief valve assembly disposed on the rocker arm and configured to selectively release oil from the hydraulic lash adjuster assembly. The pressure relief valve assembly can comprise a pressure relief valve biasing member, a plunger and a support ring. A spigot can be disposed on the rocker arm. In the engine braking mode, subsequent to opening of the first valve the predetermined distance, further rotation of the rocker arm can cause the spigot to move the valve bridge and open the second valve while further opening the first valve.

According to still other features, the oil discharge circuit is collectively defined by a first connecting passage and an outlet passage defined in the rocker arm and a pass-through channel defined in the spigot. The first connecting passage can connect a bore defined in the rocker arm that receives the disk portion with a spigot receiving passage that receives the spigot. The spigot can be configured to translate along the spigot receiving passage relative to the rocker arm. A predetermined rotation of the rocker arm will align the first connecting passage, the pass-through channel and the outlet passage and depressurize oil from under the disk portion of the needle. The hydraulic lash adjuster assembly can further comprise a second plunger body that is at least partially received by the first plunger body. The second plunger body can define a valve seat. The check valve can be disposed between the first and second plunger bodies. The check valve can further comprise a check ball that selectively seats against the valve seat on the second plunger body. The spigot can be configured to slidably translate along the spigot receiving passage prior to moving the bridge portion.

With initial reference to FIG. 1, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 10 can include a rocker assembly housing 12 that supports a rocker arm assembly 20 having a series of intake valve rocker arm assemblies 28 and a series of exhaust valve rocker arm assemblies 30. A rocker shaft 34 is received by the rocker housing 30. As will be described in detail herein, the rocker shaft 34 cooperates with the rocker arm assembly 20 and more specifically to the exhaust valve rocker arm assemblies 30 to communicate oil to the exhaust valve rocker arm assemblies 30 during engine braking.

Figure 2:
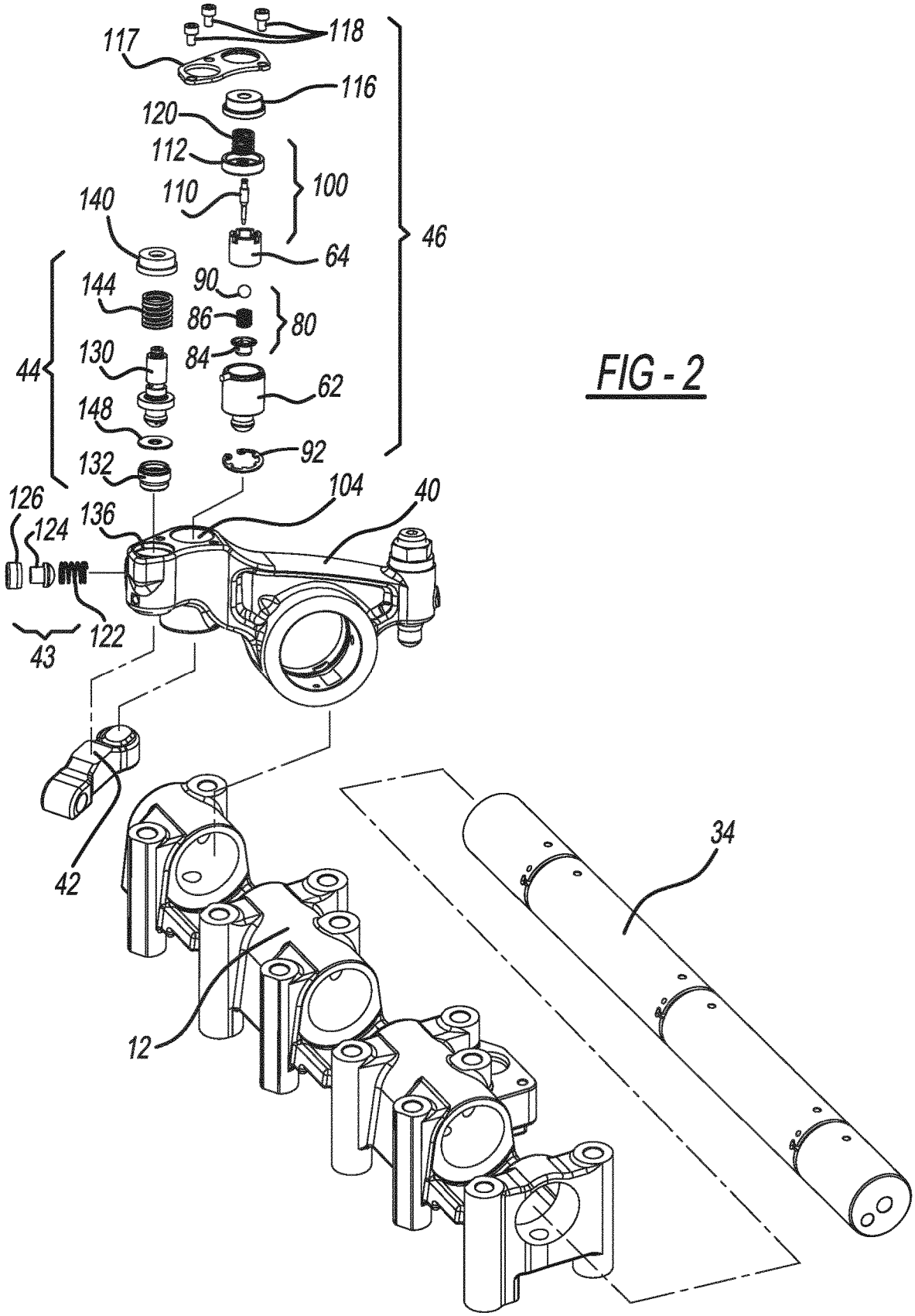
FIG. 2 an exploded view of an exhaust valve rocker arm assembly of the valve train assembly of FIG. 1.
Figure 3:
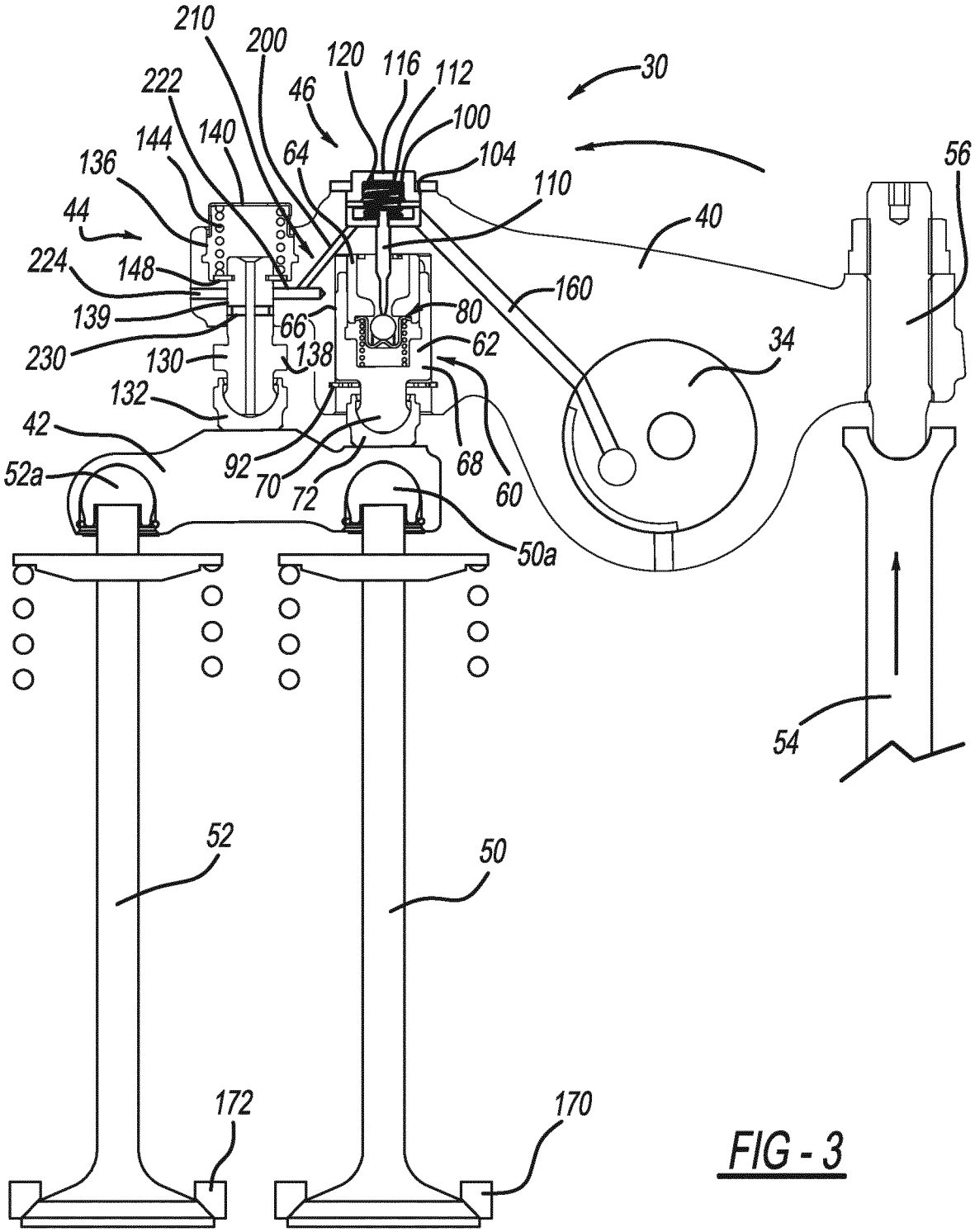
FIG. 3 a schematic illustration of an exhaust valve rocker arm assembly of the valve train assembly of FIG. 1 and shown in a default combustion mode.

With further reference now to FIGS. 2 and 3, an exhaust valve rocker arm assembly 30 will be further described. The exhaust valve rocker arm assembly 30 can generally include a rocker arm 40, a valve bridge 42, a pressure relief valve assembly 43, a spigot assembly 44 and a capsule or hydraulic lash adjuster (HLA) assembly 46. The valve bridge 42 engages a first and second exhaust valve 50 and 52 (FIG. 3) associated with a cylinder of an engine (not shown). The first and second exhaust valves 50 and 52 have a corresponding elephant foot or E-foot 50*a* and 52*a*. The E-feet 50*a* and 52*a* allow the valve bridge 42 to move without creating any side load on the corresponding valve stem 50 and 52. The E-foot 50*a* is spherical. The E-foot 52*a* is cylindrical. A pushrod 54 (FIG. 3) moves upward and downward based on a lift profile of a cam shaft (not shown). Upward movement of the pushrod 54 pushes an arm 56 fixed to the rocker arm 40 and in turn causes the rocker arm 40 to rotate counter-clockwise around the rocker shaft 34.

Figure 4:
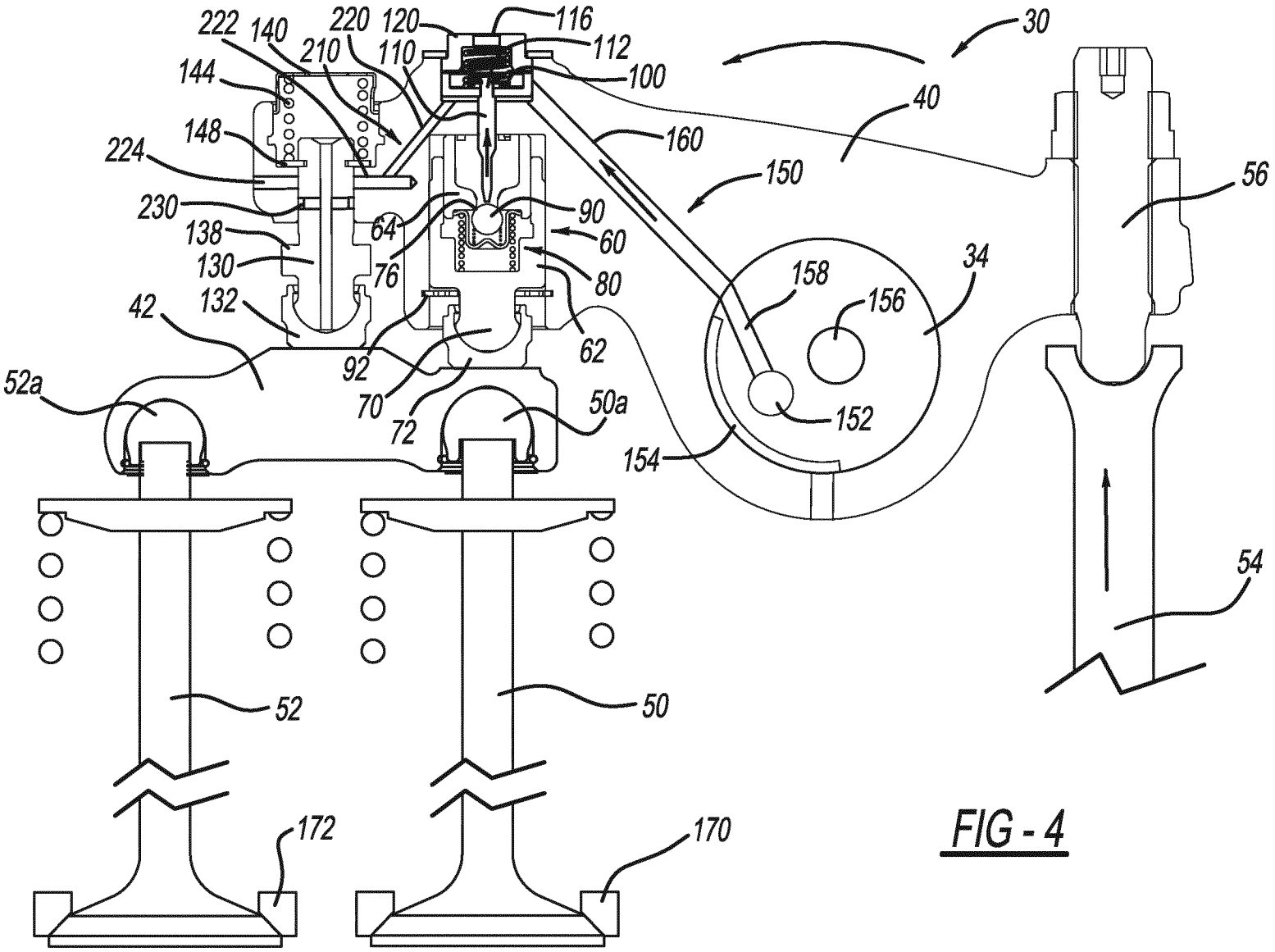
FIG. 4 a schematic illustration of the exhaust valve rocker arm assembly of FIG. 3 and shown in an engine brake mode.

The HLA assembly 46 can comprise a plunger assembly 60 including a first plunger body 62 and a second plunger body 64. The second plunger body 64 can be partially received by the first plunger body 62. The plunger assembly 60 is received by a first bore 66 defined in the rocker arm 40. The first plunger body 64 can have a first closed end 68 that defines a first spigot 70, which is received in a first socket 72 that acts against the valve bridge 42. The second plunger body 64 has an opening that defines a valve seat 76 (FIG. 4). A check ball assembly 80 can be positioned between the first and second plunger bodies 62 and 64. The check ball assembly 80 can include a first biasing member 82, a cage 84, a second biasing member 86 and a check ball 90. A snap ring 92 nests in a radial groove provided in the first bore 66 of the rocker arm 40. The snap ring 92 retains the first plunger body 62 in the first bore 66.

An actuator or needle 100 is received in a second bore 104 of the rocker arm 40. The needle 100 acts as an actuator that selectively releases pressure in the HLA assembly 46. The needle 100 includes a longitudinal pin portion 110 and an upper disk portion 112. A first cap 116 is fixed to the rocker arm 40 with a plate 117 and a plurality of fasteners 118 at the second bore 104 and captures a biasing member 120 therein. The biasing member 120 acts between the first cap 116 and the upper disk portion 112 of the needle 100. In the example shown, the biasing member 120 biases the needle 100 downwardly as viewed in FIG. 3.

The pressure relief valve assembly 43 will now be described in greater detail. In general, the pressure relief valve assembly 43 can release oil from the HLA assembly 46, minimizing or eliminating the amount of oil that pushes back against the engine pump. The pressure relief valve assembly 43 can generally include a biasing member 122, a plunger 124 and a support ring 126. As will become appreciated herein, the pressure relief valve assembly 43 can be configured to open when pressure inside the first plunger body 62 of the HLA assembly 46 reaches a predetermined threshold. In one non-limiting example, the pressure relief valve assembly 43 can open when the pressure reaches a certain pressure threshold. In one advantage of the pressure relief valve assembly 43, oil entering the HLA assembly 46 is permitted to exit the HLA assembly 46 in the same direction. In this regard, the inertia of the oil can be generally maintained from entering the HLA assembly 46 to exiting the HLA assembly 46 toward the pressure relief valve assembly 43. Such a configuration can allow the HLA assembly 46 to discharge relatively quickly keeping the pressure in side the HLA assembly 46 very low even during the discharge phase. Moreover, the configuration requires relatively low force to discharge the HLA assembly 46 benefitting valve motion control. Explained further, the force to discharge the HLA assembly 46 comes from one of the two valves 50, 52. If a large force is needed, one of the two valves 50, 52 is lowered down during closure and parallel closure of the valves 50, 52 is compromised. If the required force is reduced (such as with the present configuration), to discharge the HLA assembly 46, the two valves 50, 52 can close almost parallel benefitting control and improving closing speed. In addition, the strength of the biasing member 120 need not be substantial as the required force to maintain the actuator 100 in the down position is also reduced.

The spigot assembly 44 will be described in greater detail. The spigot assembly 44 can generally include a lost motion shaft or second spigot 130 having a distal end that is received by a second socket 132 and a proximal end that extends into a third bore 136 defined in the rocker arm 40. A collar 138 can extend from an intermediate portion of the second spigot 130. The second spigot 130 can extend through a passage 139 formed through the rocker arm 40. A second cap 140 is fixed to the rocker arm 40 at the third bore 136 and captures a biasing member 144 therein. The biasing member 144 acts between the second cap 140 and a snap ring 148 fixed to the proximal end of the second spigot 130. As will be described, the second spigot 130 remains in contact with the rocker arm 40 and is permitted to translate along its axis within the passage 139.

With reference now to FIGS. 4, and 11-13, an oil circuit 150 of the rocker arm assembly 20 will now be described. The rocker shaft 34 can define a central pressurized oil supply conduit 152, a vent oil passage or conduit 154, a lubrication conduit 156 and a lash adjuster oil conduit 180. The vent oil conduit 154 can have a vent lobe 157 extending generally parallel to an axis of the rocker shaft 34 and transverse to the vent oil conduit 154. A connecting passage 158 (FIG. 11) can connect the central pressurized oil supply conduit 152 with an oil supply passage 160 defined in the rocker arm 40. The lash adjuster oil conduit 180 can be used to supply oil to the HLA assembly 46.

Returning now to FIGS. 4-9, an oil discharge circuit 210 provided in the exhaust valve rocker arm assembly 30 will be described. The oil discharge circuit 210 is collectively defined by a first connecting passage 220, a second connecting passage 222, an outlet passage 224 and a pass-through channel 230. The first connecting passage 220, second connecting passage 222 and the outlet passage 224 are defined in the rocker arm 40. The pass-through channel 230 is defined through the second spigot 130. In general, the first connecting passage 220 and the second connecting passage 222 connect the second bore 104 of the rocker arm 40 that receives the upper disk portion 112 of the needle 100 with the third bore 136 of the rocker arm 40 that receives the second spigot 130. When the second spigot 130 moves upward in the third bore 136, the pass-through channel 230 aligns with the second connecting passage 222 and the outlet passage 224 (see FIG. 6) allowing oil to depressurize from below the upper disk portion 112 and ultimately flow out of the outlet passage 224.

As discussed herein, the pressurized oil supply conduit 152, the connecting passage 158 and the oil supply passage 160 cooperate to supply pressurized oil to the second bore 104 to urge the upper disk portion 112 of the needle 100 upward. As the rocker arm 40 rotates around the rocker shaft 34, the vent lobe 157 will align with the oil supply passage 160 causing oil to be vented away from the second bore 104 through the vent oil conduit 154. As described herein, oil is also drained through the discharge oil circuit 210. When the pressure drops in the second bore 104, the second spring 120 will urge the needle 100 downward such that the longitudinal pin 110 will act against the ball 90 and move the ball away from the valve seat 76. Oil is then permitted to flow through the valve seat 76 and out of the HLA assembly 46 through the pressure relief valve assembly 43.

Figure 5:
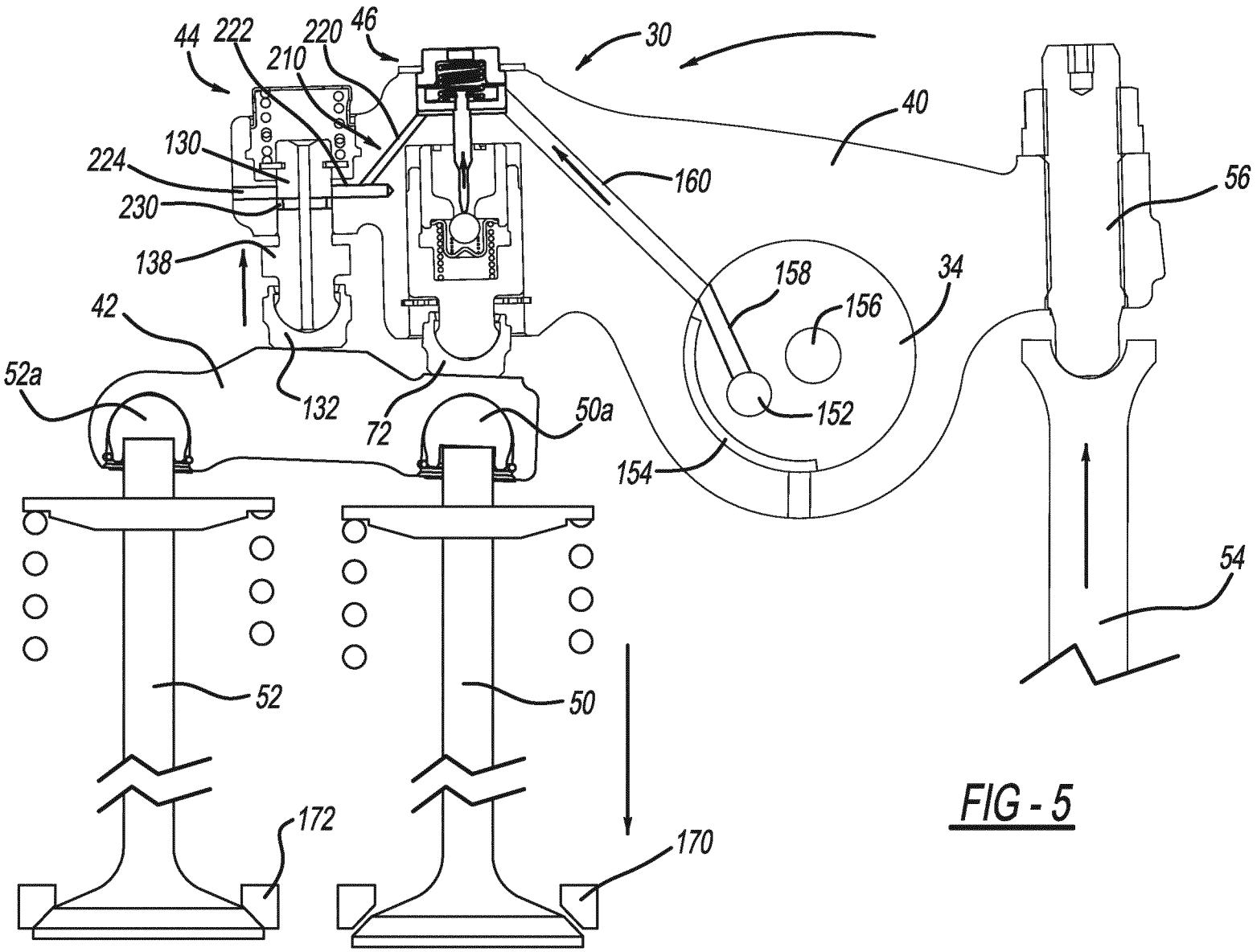
FIG. 5 a schematic illustration of the exhaust valve rocker arm assembly of FIG. 4 and shown in engine brake mode with initial rotation of the rocker arm in the counterclockwise direction and a first exhaust valve beginning to open.
Figure 6:
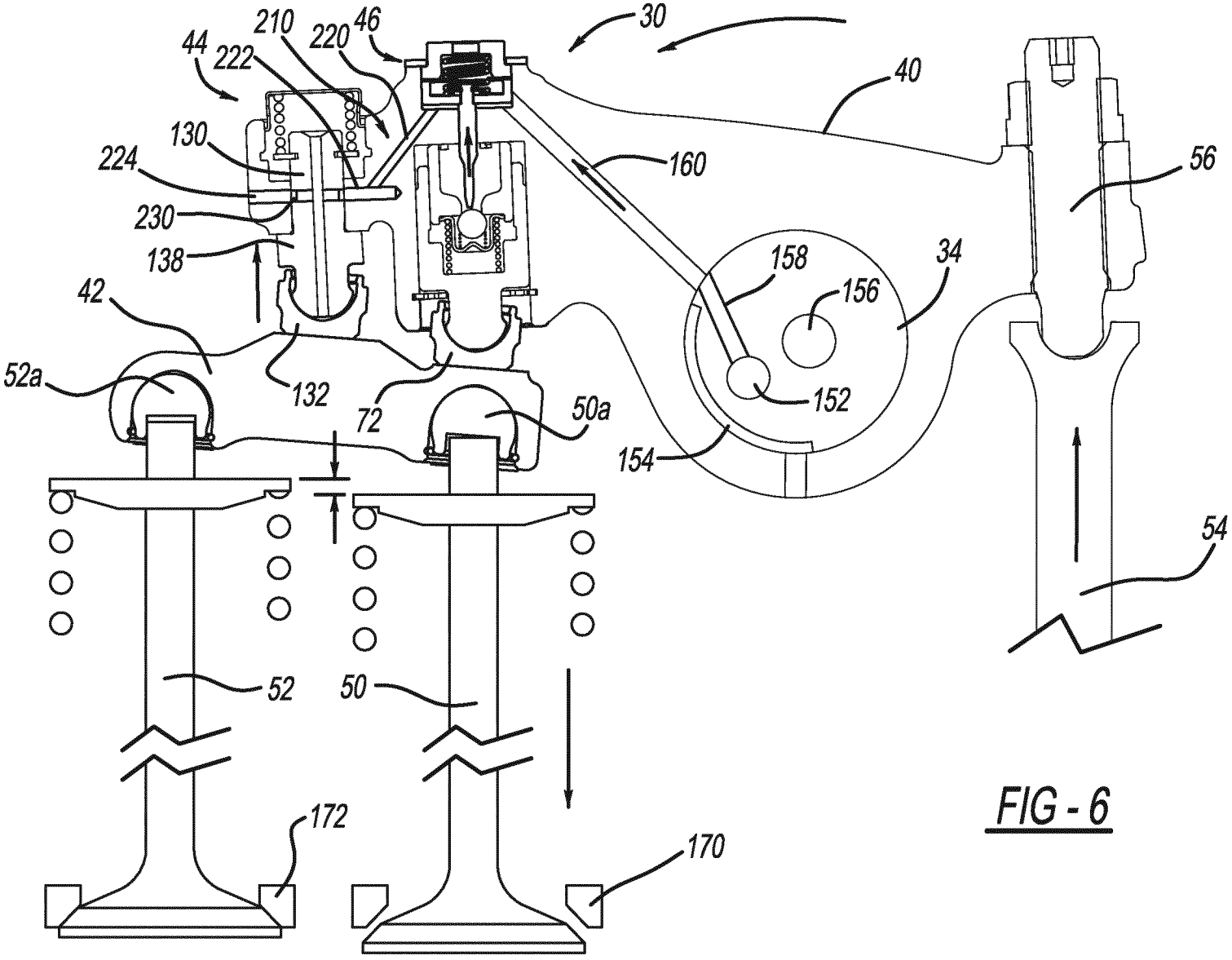
FIG. 6 a schematic illustration of the exhaust valve rocker arm assembly of FIG. 5 and shown in engine brake mode with further rotation of the rocker arm in the counterclockwise direction and with the first exhaust valve further opening.

As will become appreciated herein, the exhaust rocker arm assembly 30 can operate in a default combustion engine mode with engine braking off (FIG. 3) and an engine braking mode (FIGS. 4-6). When the exhaust rocker arm assembly 30 is operating in the default combustion engine mode (FIG. 3), an oil control valve 152 is closed (not energized). As a result, the oil supply passage 160 defined in the rocker arm 40 has a low pressure level. Other pressures may be used. With low pressure, the biasing member 120 will force the needle 100 in a downward direction causing the longitudinal pin portion 110 to urge the ball 90 away from the valve seat 76. The check ball assembly 80 is therefore open causing the HLA assembly 46 to become "soft" and not influencing a downward force upon the valve bridge 42. In the default combustion engine mode (FIG. 3), rotation of the rocker arm 40 in the counter-clockwise direction will continue causing the collar 138 on the second spigot 130 to engage the rocker arm 40. Continued rotation of the rocker arm 40 will cause both the first and the second valves 50 and 52 to open together.

Figure 4A:
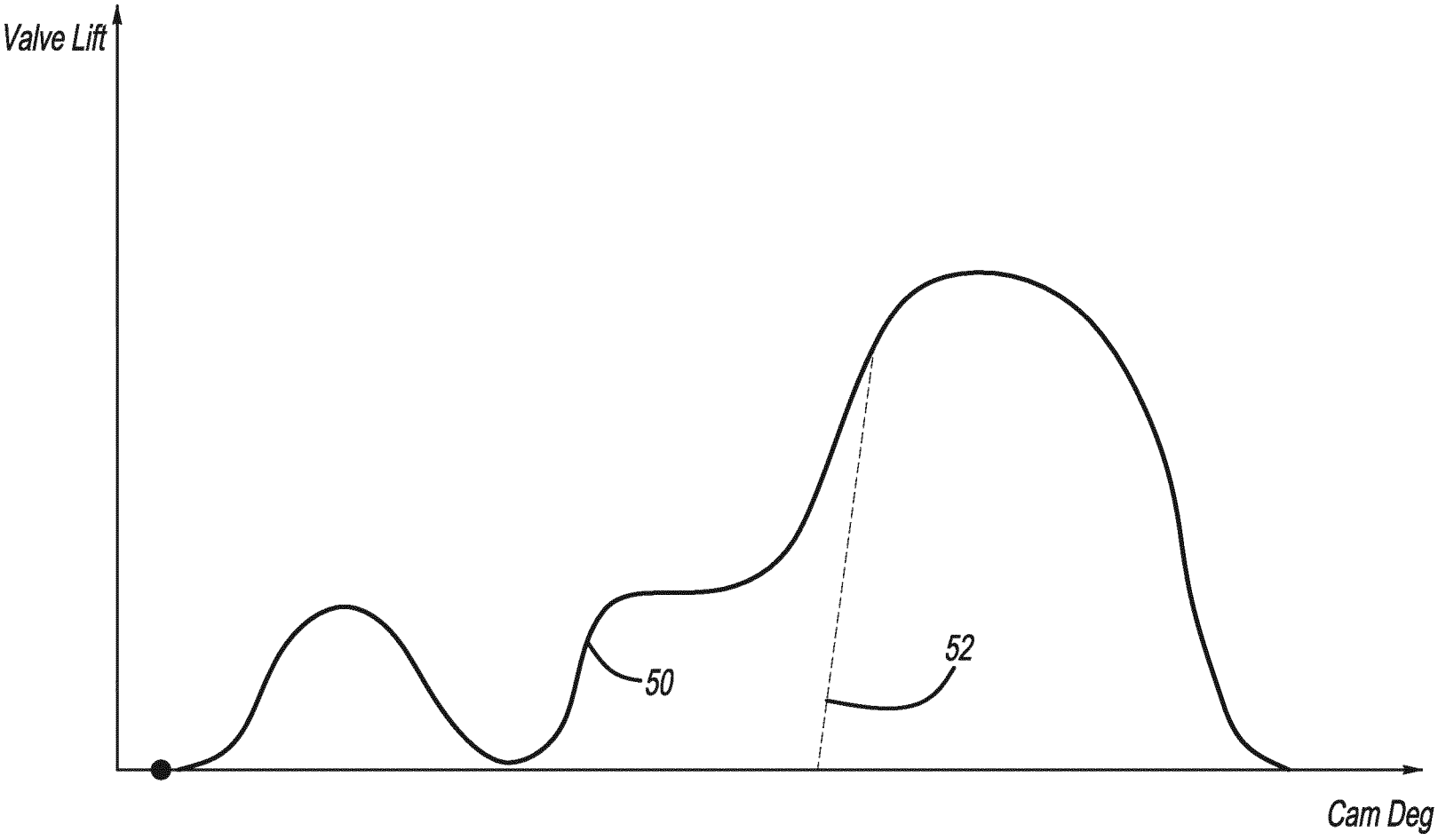
FIG. 4A a plot of cam degrees versus valve lift for the exhaust valve rocker arm assembly of the present teachings and identifying the position of FIG. 4 on the base circle.

With specific reference now to FIG. 4, operation of the exhaust valve rocker arm assembly 30 in the engine braking mode will be described. In braking mode, oil pressure is increased in oil supply passage 160 causing the needle 100 to move upward against the bias of the biasing member 120. As a result, the longitudinal pin portion 110 is moved away from the check ball 90. The HLA assembly 46 acts as a no-return valve with the first plunger body 62 rigidly extending toward the valve bridge 42. Notably, in FIG. 4, the discharge oil circuit 210 is blocked because the pass-through channel 230 of the second spigot 130 is not aligned with the second connecting passage 222 and the outlet passage 224. FIG. 4A is a plot of cam degrees versus valve lift for the exhaust valve rocker arm assembly of the present teachings and identifying the position of FIG. 4 on the base circle.

Turning now to FIG. 5, the rocker arm 40 has rotated further counter-clockwise around the rocker shaft 34. In the example shown, the rocker arm 40 has rotated 2.72 degrees. Because the HLA assembly 46 is rigid, the first spigot 70 will force the first socket 72 against the valve bridge 42 causing the first valve 50 to move off a first valve seat 170. In this example, the first valve 50 moves off the first valve seat 170 a distance of 2.85 mm. It will be appreciated that other distances (and degrees of rotation of the rocker arm 40) are contemplated. Notably, the second valve 52 remains closed against a second valve seat 172. The collar 138 on the second spigot 130, while traveling toward the rocker arm 40, has not yet reached the rocker arm 40.

Figure 5A:
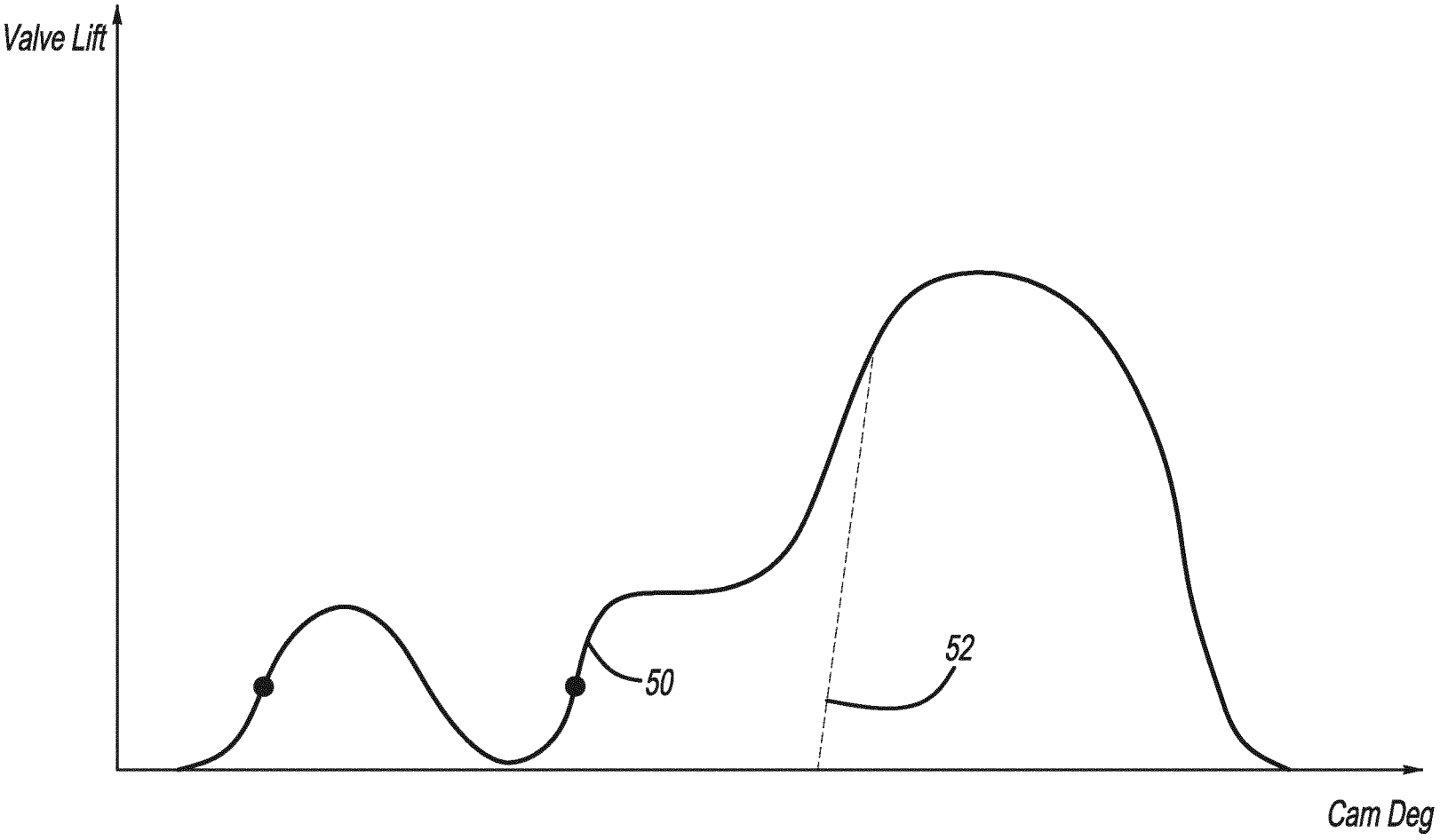
FIG. 5A a plot of cam degrees versus valve lift for the exhaust valve rocker arm assembly of the present teachings and identifying the position of FIG. 5 with the lost motion shaft at 2 mm of lost motion.

In FIG. 5, the second spigot 130 has moved about 2 mm of lost motion and remains in contact (through the second socket 132) with the rocker arm 40. Notably, the pass-through channel 230 of the second spigot 130 starts to put in communication the first and second connecting passages 220 and 222 with the outlet passage 224. From this position up, the oil from under the upper disk portion 112 of the needle 100 is flowing out the oil discharge circuit 210. In FIG. 5 however, the longitudinal pin 110 cannot be pushed down because the force of the biasing member 120 is lower than the force generated inside the HLA assembly 46 keeping the check ball assembly 80 closed. The oil supply passage 160 remains in communication with the connecting passage 158. FIG. 5A is a plot of cam degrees versus valve lift for the exhaust valve rocker arm assembly of the present teachings and identifying the position of FIG. 5 with the lost motion shaft at 2 mm of lost motion.

Figure 6A:
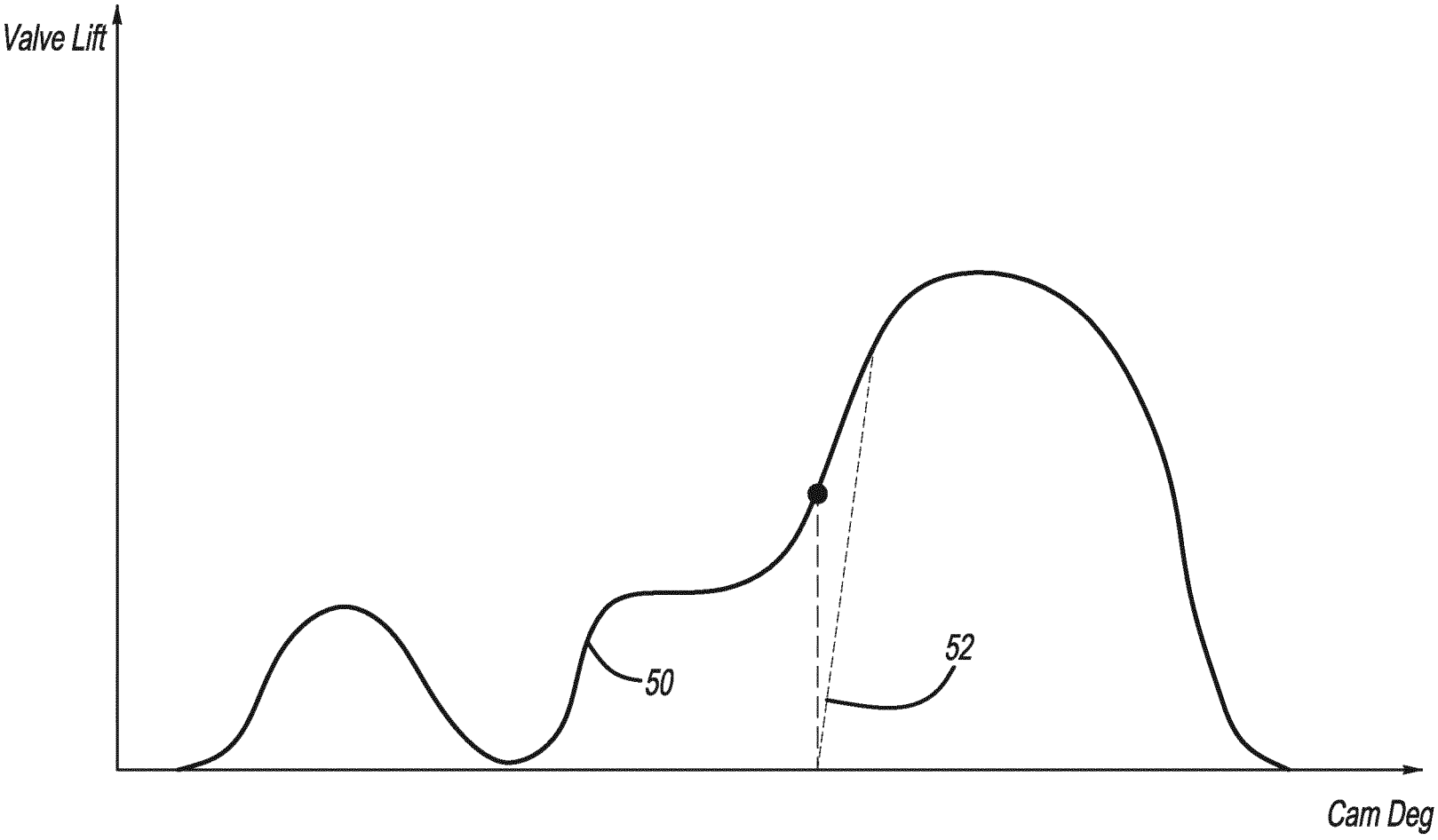
FIG. 6A a plot of cam degrees versus valve lift for the exhaust valve rocker arm assembly of the present teachings and identifying the position of FIG. 6 when the lost motion shaft has bottomed.

With reference now to FIG. 6, the rocker arm 40 has rotated further counter-clockwise around the rocker shaft 34. In the example shown, the rocker arm 40 has rotated 4.41 degrees. Again, the HLA assembly 46 remains rigid and the first spigot 70 continues to force the first socket 72 against the valve bridge 42 causing the first valve 50 to move further off the first valve seat 170. In this example, the first valve 50 moves off the first valve seat 170 a distance of 4.09 mm. It will be appreciated that other distances (and degrees of rotation of the rocker arm 40) are contemplated. At this point the collar 138 has made contact with the rocker arm 40 (lost motion has bottomed) and both the first and second valves 50 and 52 will be opened concurrently. The pass-through channel 230 is fully aligned with the first and second connecting passages 220 and 222 and the outlet passage 230 allowing oil from under the upper disk portion 112 of the needle 100 to depressurize out through the oil discharge circuit 210. In FIG. 6 however, the longitudinal pin 110 cannot be pushed down because the force of the biasing member 120 is lower than the force generated inside the HLA assembly 46 keeping the check ball assembly 80 closed. The oil supply passage 160 remains in communication with the connecting passage 158. FIG. 6A is a plot of cam degrees versus valve lift for the exhaust valve rocker arm assembly of the present teachings and identifying the position of FIG. 6 when the lost motion shaft has bottomed.

Figure 7:
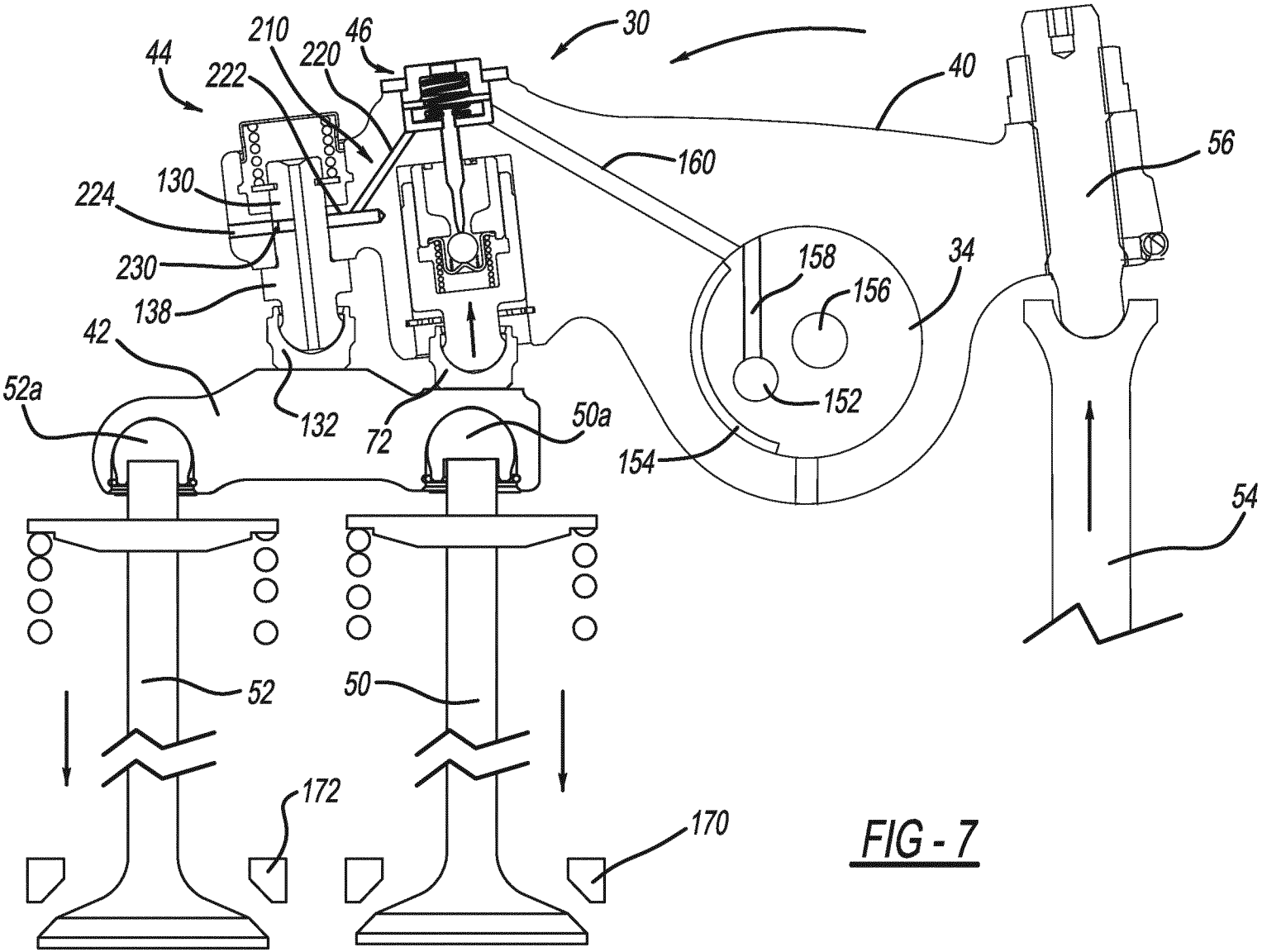
FIG. 7 a schematic illustration of the exhaust valve rocker arm assembly of FIG. 6 and shown in engine brake mode with further rotation of the rocker arm in the counterclockwise direction and shown with the first and a second exhaust valves both opened.
Figure 7A:
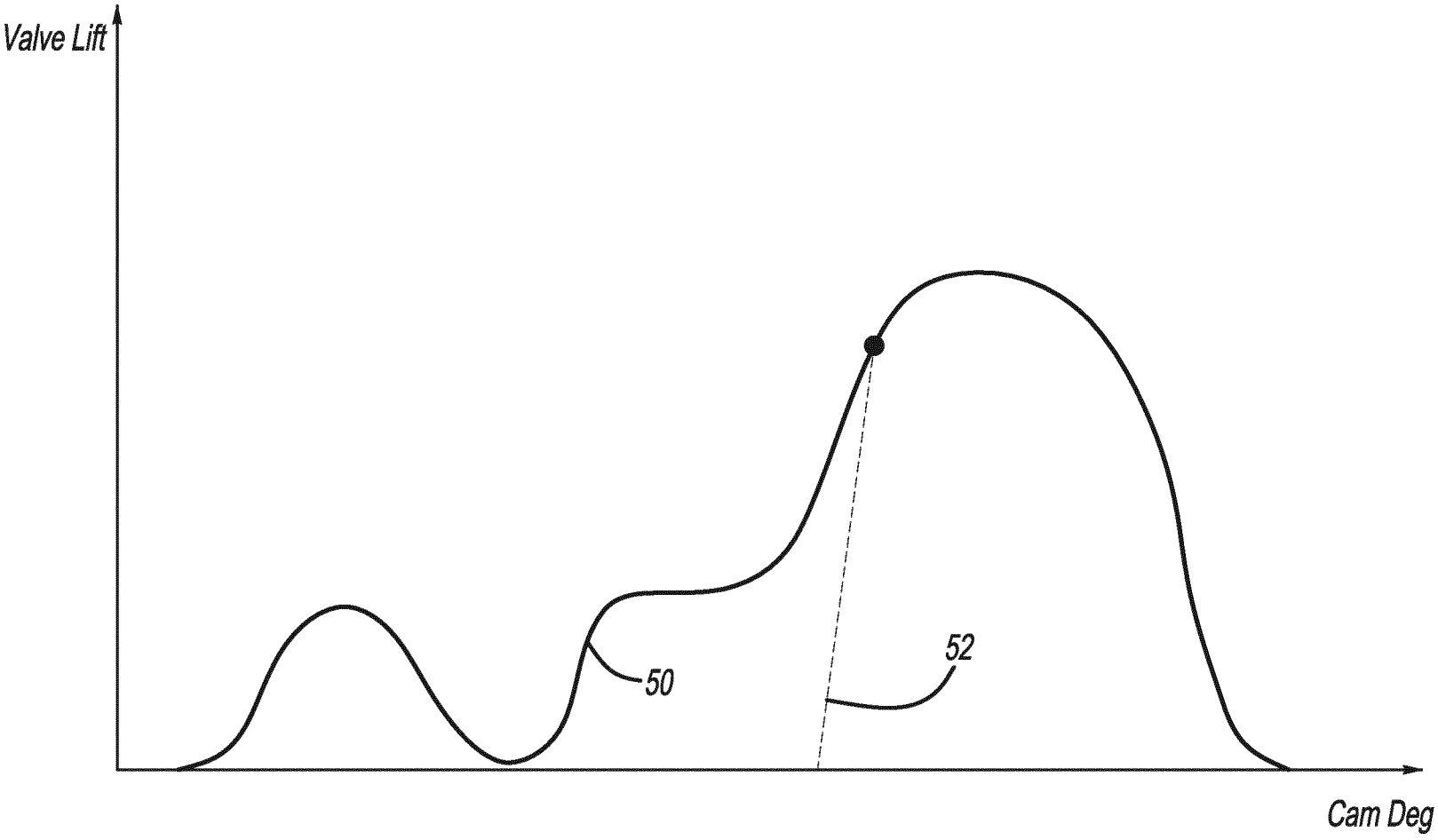
FIG. 7A a plot of cam degrees versus valve lift for the exhaust valve rocker arm assembly of the present teachings and identifying the position of FIG. 7 with the bridge in a horizontal position.

Turning now to FIG. 7, the rocker arm 40 has rotated further counter-clockwise around the rocker shaft 34. In the example shown, the rocker arm 40 has rotated 8.82 degrees and the bridge 42 is in a horizontal position. Again, the HLA assembly 46 remains rigid. Regardless, the second spigot 130 urges the bridge 42 downward to open the first and second valves 50 and 52 off their respective valve seats 170 and 172. In this example, the first and second valves 50 and 52 have the same lift and are moved off their valve seats 170 and 172 a distance of 9.1 mm. It will be appreciated that other distances (and degrees of rotation of the rocker arm 40) are contemplated. The force from the valves 50 and 52 is fully applied to the second socket 132 and the HLA assembly 46 is no more under load as the check ball assembly 80 is moved to the open position (check ball 90 has moved off valve seat). The oil supply passage 160 is no longer in communication with the connecting passage 158 and therefore the oil from under the upper disk portion 112 of the needle 100 flows out allowing the needle 100 to move downward. At this point, the force of the biasing member 120 is sufficient to open the check ball 90. FIG. 7A is a plot of cam degrees versus valve lift for the exhaust valve rocker arm assembly of the present teachings and identifying the position of FIG. 7 with the bridge in a horizontal position.

Figure 8:
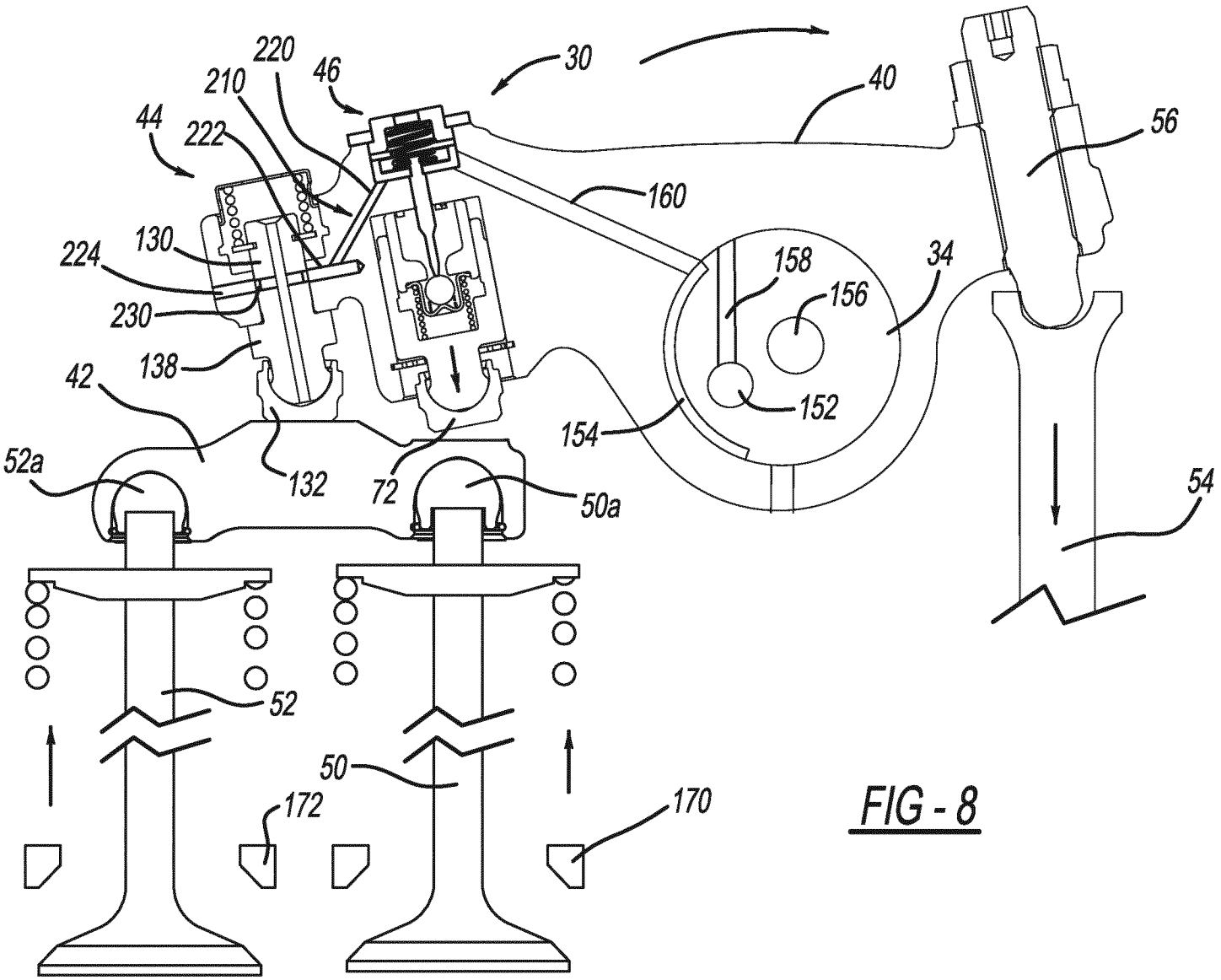
FIG. 8 a schematic illustration of the exhaust valve rocker arm assembly of FIG. 7 and shown in engine brake mode with further rotation of the rocker arm in the counterclockwise direction and with both exhaust valves fully opened.
Figure 8A:
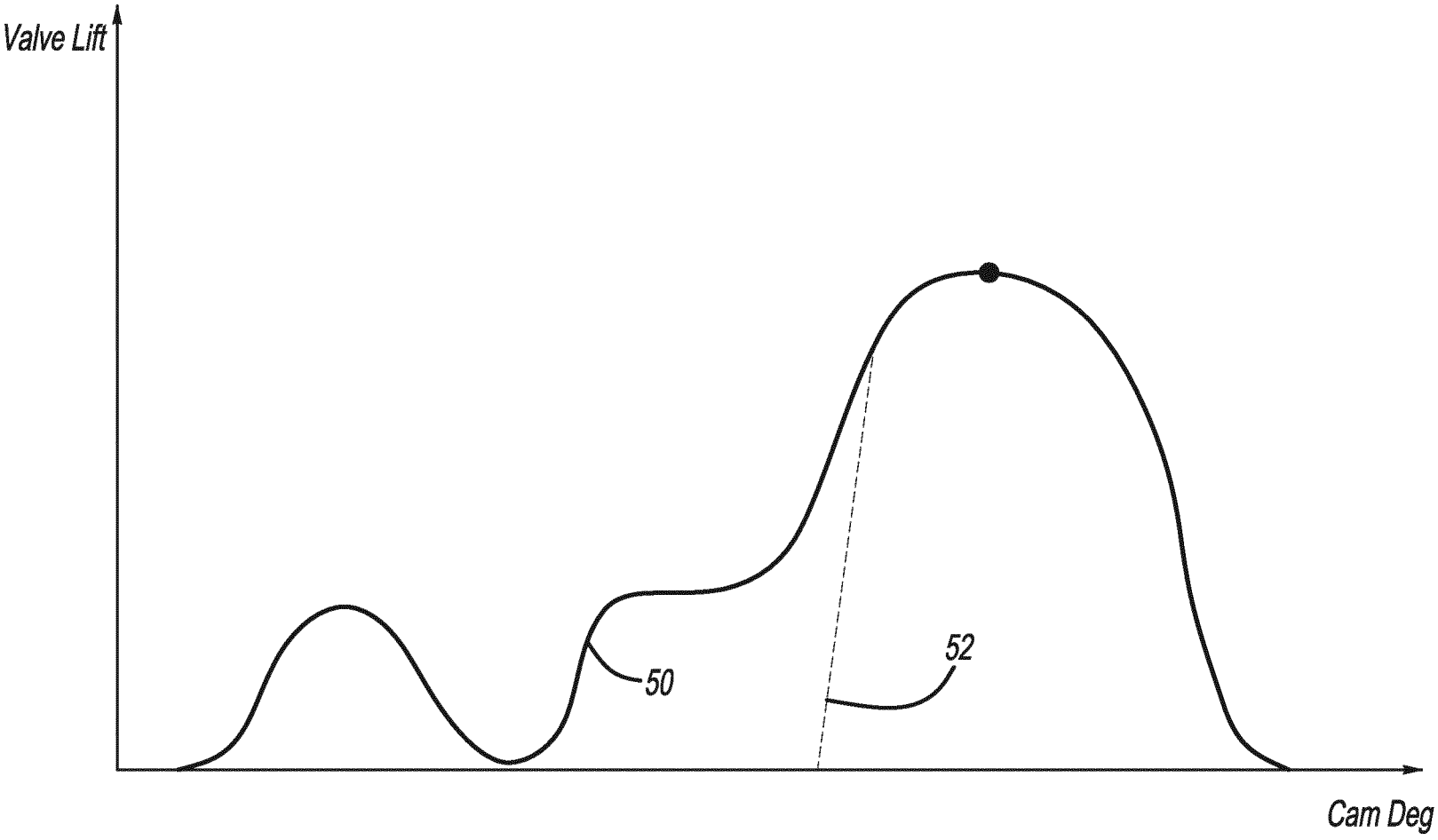
FIG. 8A a plot of cam degrees versus valve lift for the exhaust valve rocker arm assembly of the present teachings and identifying the position of FIG. 8 with the valves at full lift.
Figure 9:
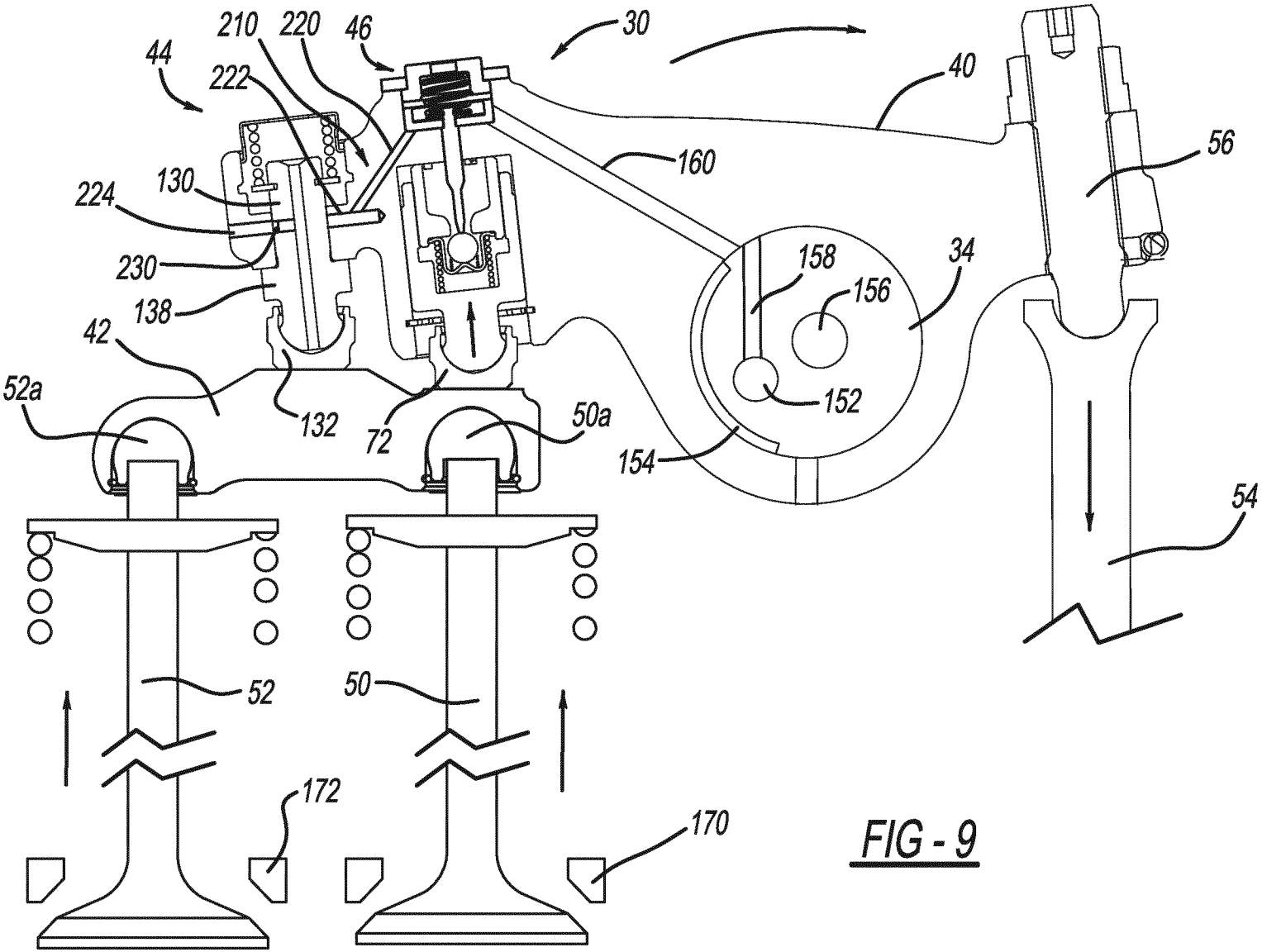
FIG. 9 a schematic illustration of the exhaust valve rocker arm assembly of FIG. 8 and shown during initial valve closure.
Figure 9A:
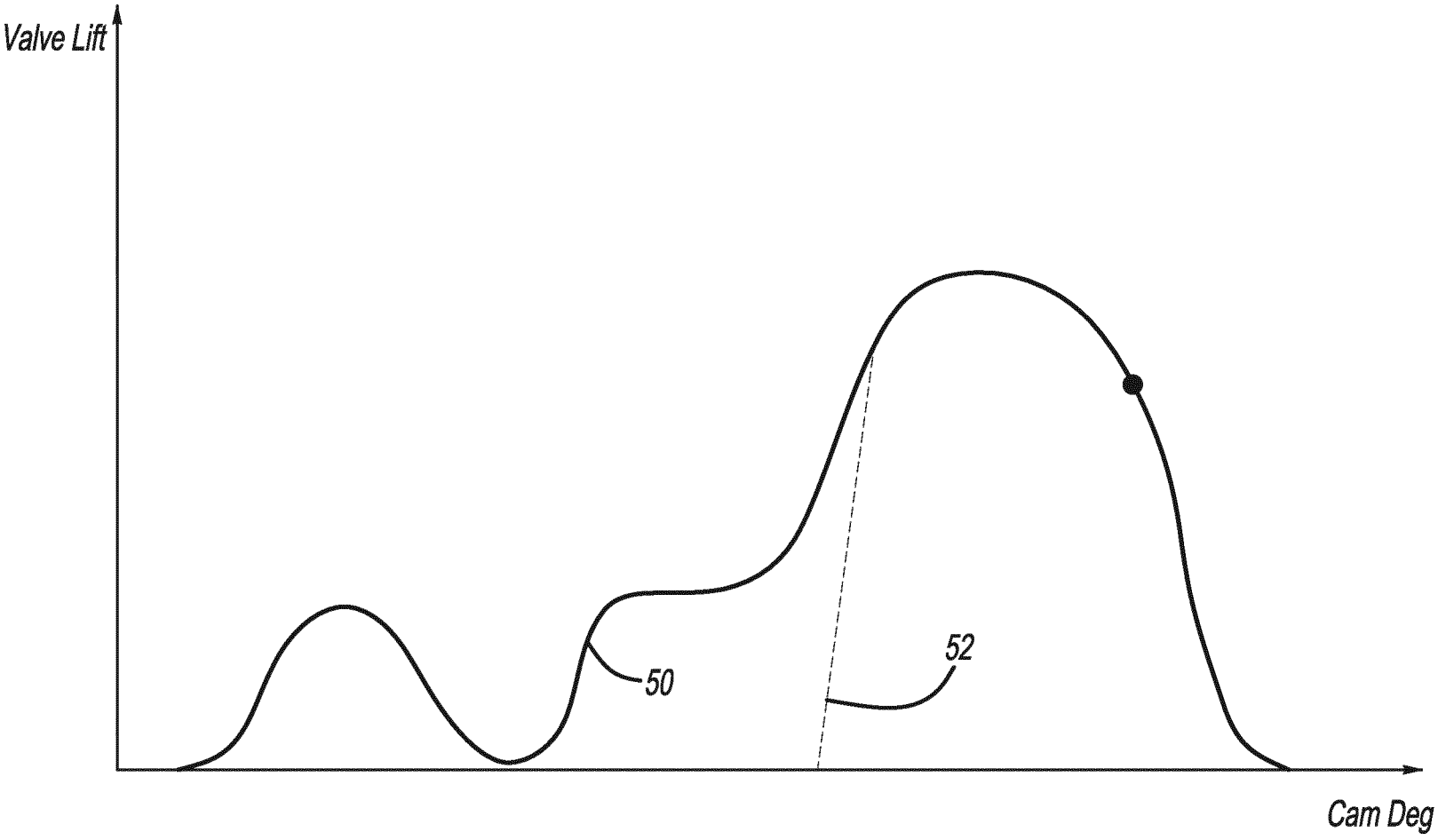
FIG. 9A a plot of cam degrees versus valve lift for the exhaust valve rocker arm assembly of the present teachings and identifying the position of FIG. 9 during initial valve closure.
Figure 12:
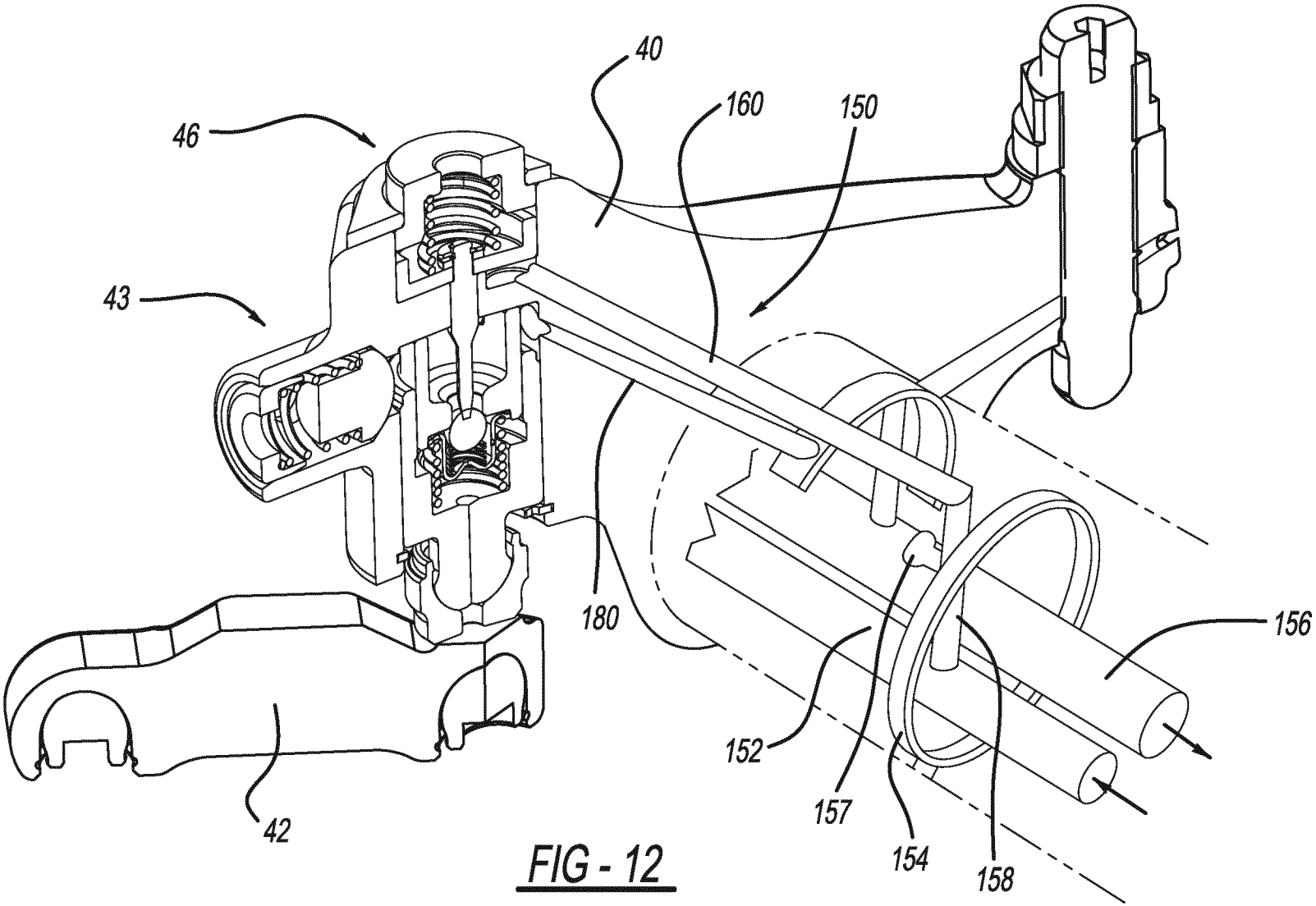
FIG. 12 a phantom perspective view of the oil circuit of the exhaust rocker arm assembly.
Figure 13:
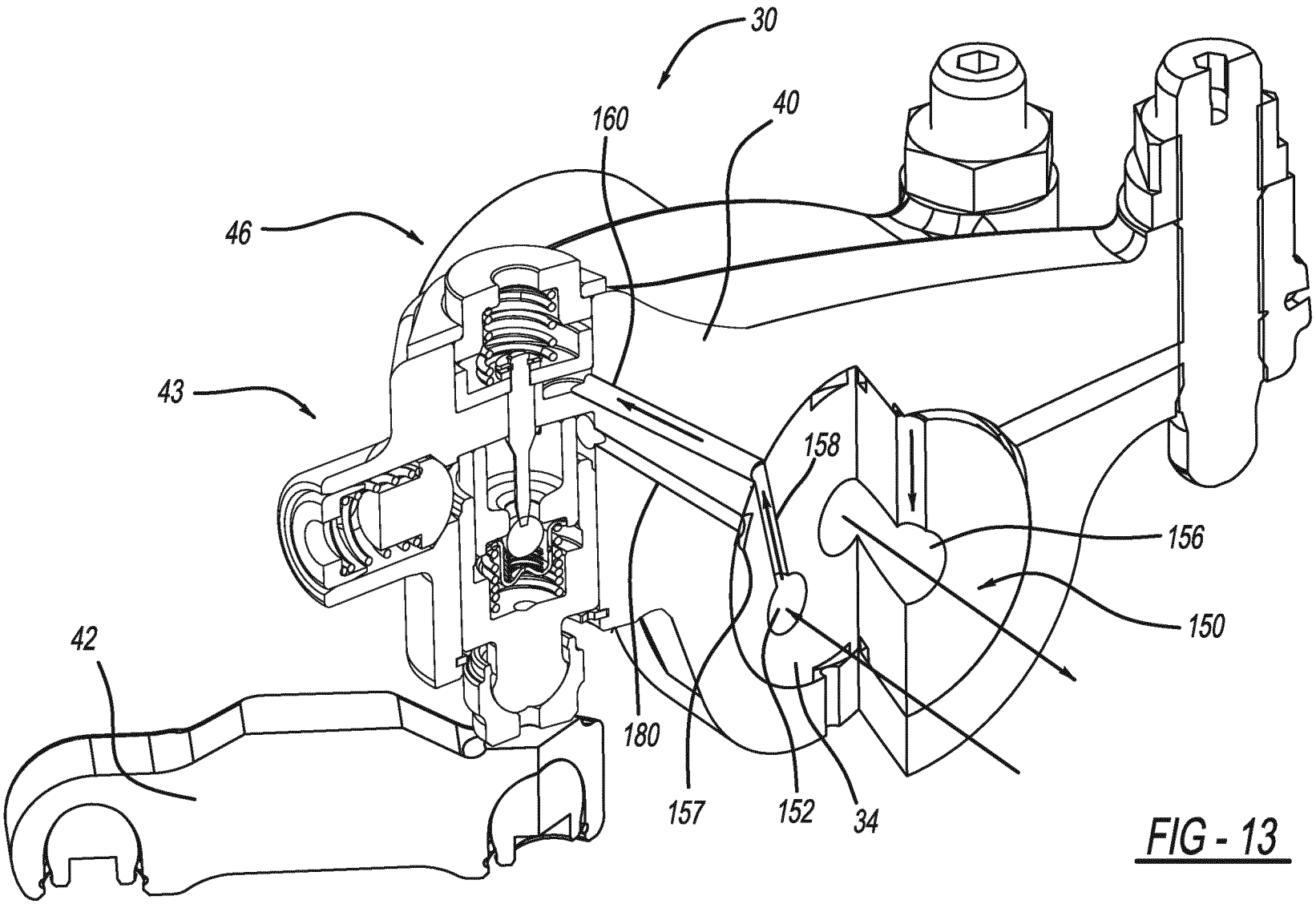
FIG. 13 a sectional view of the exhaust rocker arm assembly taken along lines 13-13 of FIG. 12.

With reference now to FIG. 8, the rocker arm 40 has rotated further counter-clockwise around the rocker shaft 34. In the example shown, the rocker arm 40 has rotated 12.9 degrees. At this point, the rocker arm 40 has rotated 12.9 degrees and the first and second valves 50 and 52 are at maximum lift off their valve seats 170 and 172. In the example shown the first and second valves 50 and 52 are displaced 15.2 mm off their respective valve seats 170 and 172. As shown, the oil supply passage 160 in the rocker arm 40 is fully disconnected from the connecting passage 158 of the central pressurized oil supply conduit 152 and is now connected to the vent oil conduit 154 by way of the vent lobe 157. In this position, the supply of pressurized oil is interrupted and the oil pressure will drop in the oil supply passage 160. As a result, the biasing member 120 urges the needle 100 downward such that the longitudinal pin portion 110 pushes the check ball 90 off the valve seat 76, opening the HLA assembly 46. Once the check ball 90 is open, the HLA assembly 46 becomes "soft" again and during valve closing will not exercise any force on the first valve 50 that could otherwise prevent its closing. Once the pushrod 54 occupies a position consistent with the base circle on the cam (not shown), the above process will continuously repeat until combustion mode is selected. FIG. 8A is a plot of cam degrees versus valve lift for the exhaust valve rocker arm assembly of the present teachings and identifying the position of FIG. 8 with the valves at full lift;

With reference to FIG. 9, the rocker arm 40 begins to rotate clockwise toward valve closure. When the valves 50 and 52 are closing, the oil supply passage 160 is no longer in communication with the vent oil conduit 154, but the discharge oil circuit 210 remains open and allows oil from under the upper disk portion 112 of the needle 100 to continue to discharge if necessary. The HLA assembly 46 is starting to be pushed upward by the bridge 42 discharging the oil through the pressure relief valve 43 (FIGS. 2, 12 and 13). FIG. 9A is a plot of cam degrees versus valve lift for the exhaust valve rocker arm assembly of the present teachings and identifying the position of FIG. 9 during initial valve closure.

Figure 10:
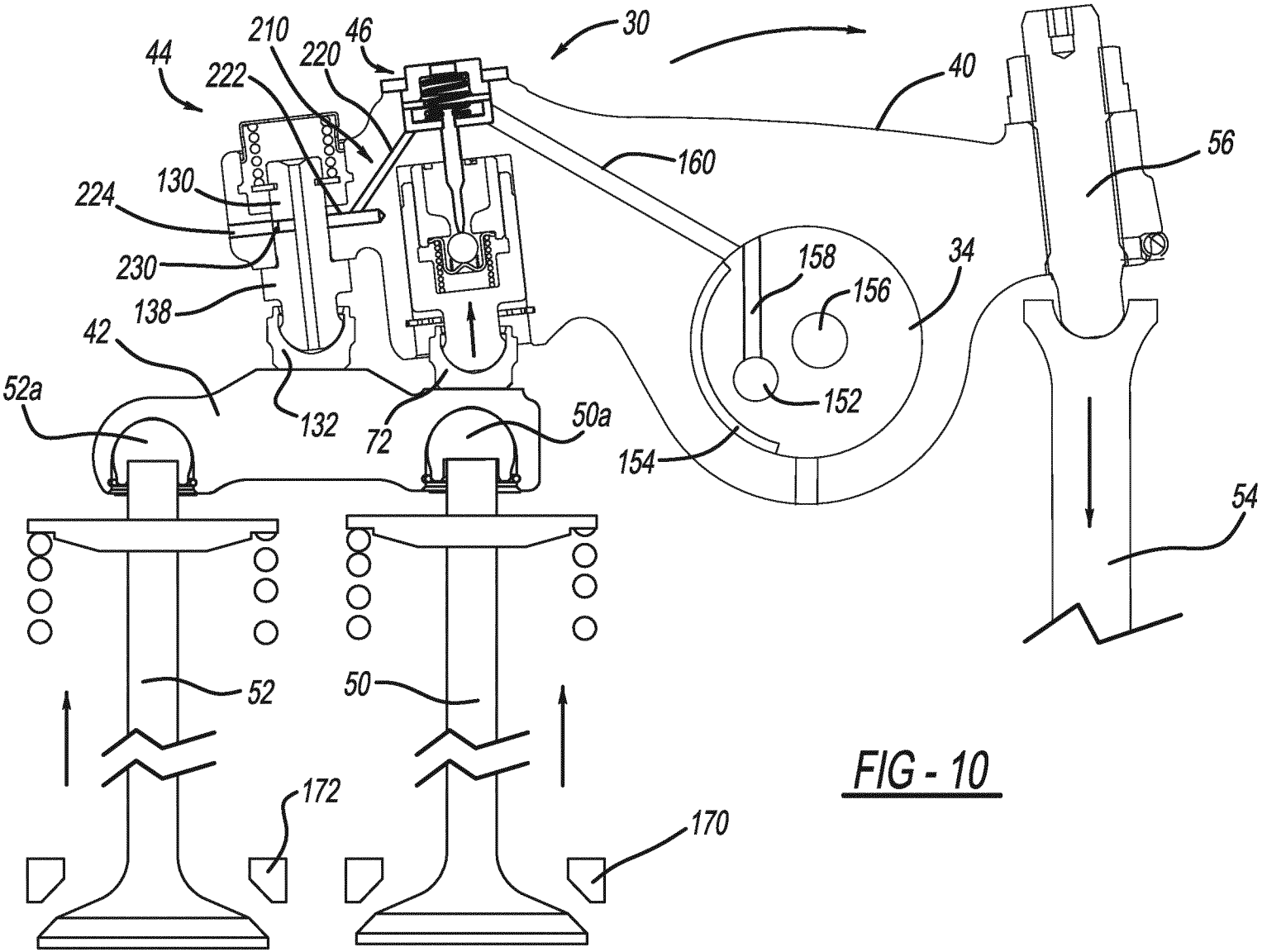
FIG. 10 a schematic illustration of the exhaust valve rocker arm assembly of FIG. 9 and shown during further valve closure.
Figure 10A:
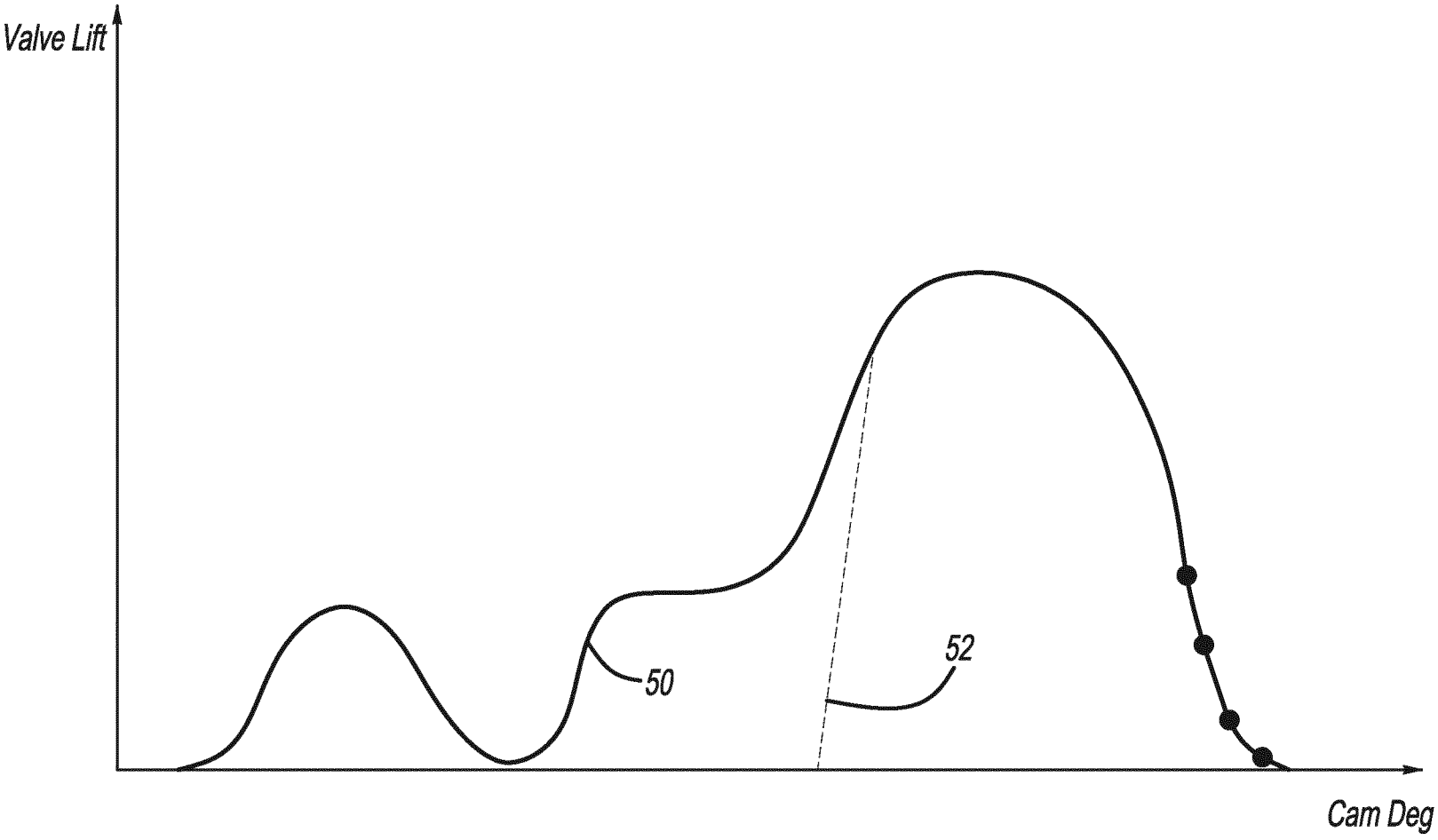
FIG. 10A a plot of cam degrees versus valve lift for the exhaust valve rocker arm assembly of the present teachings and identifying the position of FIG. 10 during further valve closure.
Figure 11:
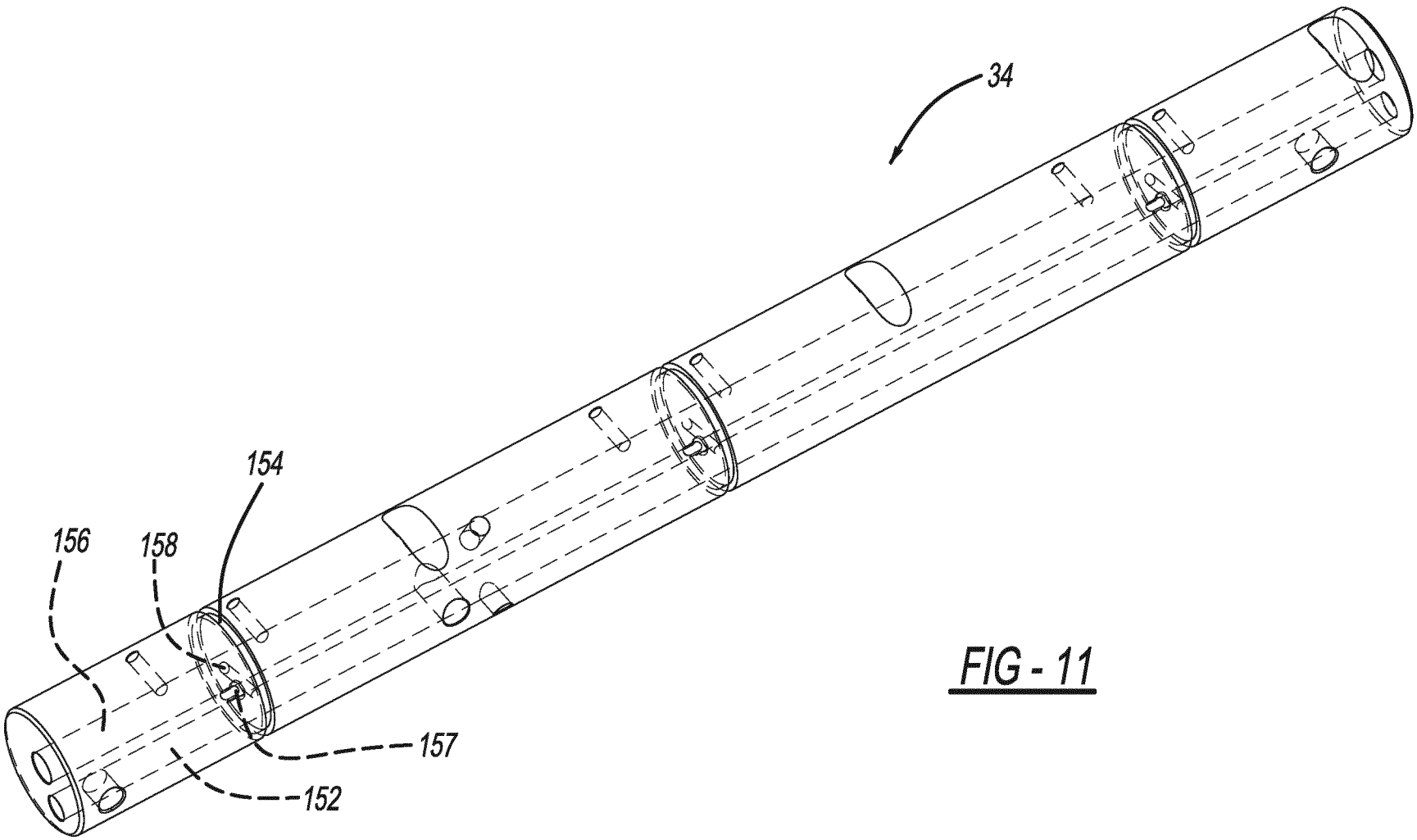
FIG. 11 a perspective view of a rocker shaft of the rocker arm assembly of FIG. 1.

With reference to FIG. 10, further valve closure is shown. When the valves 50 and 52 are getting closer to their respective valve seats 170 and 172, the oil supply passage 160 will again move into fluid communication with the connecting passage 158. At this point however the pressurized oil coming from the connecting passage 158 will not be able to push up the needle 100 because the discharge oil circuit 210 is still open or in communication with ambient. This will guarantee that the check ball assembly 80 will stay opened for an extended time helping the HLA assembly 46 to fully discharge. FIG. 10A is a plot of cam degrees versus valve lift for the exhaust valve rocker arm assembly of the present teachings and identifying the position of FIG. 10 during further valve closure.

Figure 14:
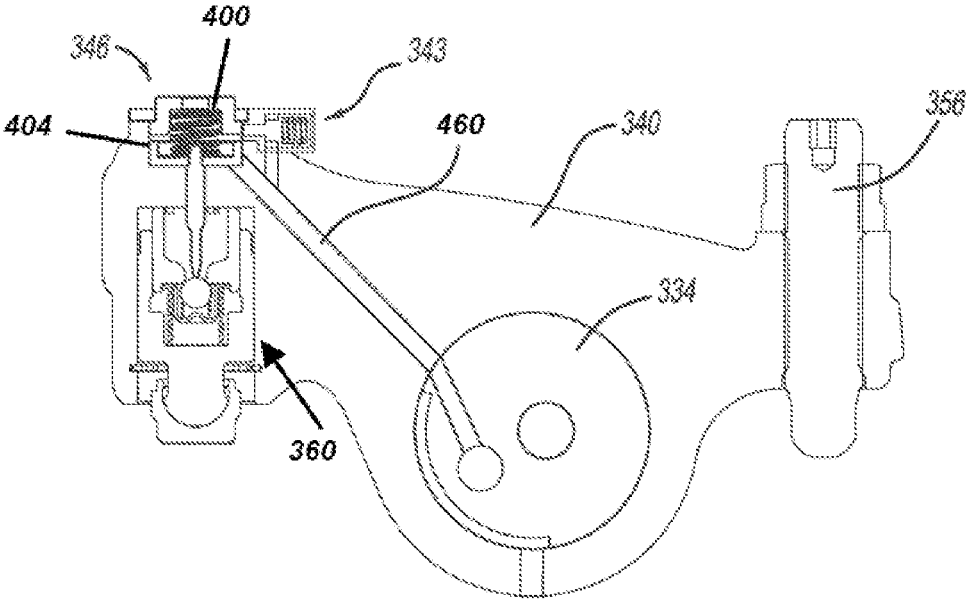
FIG. 14 a schematic illustration of an exhaust valve rocker arm assembly constructed in accordance to additional features.
Figure 15:
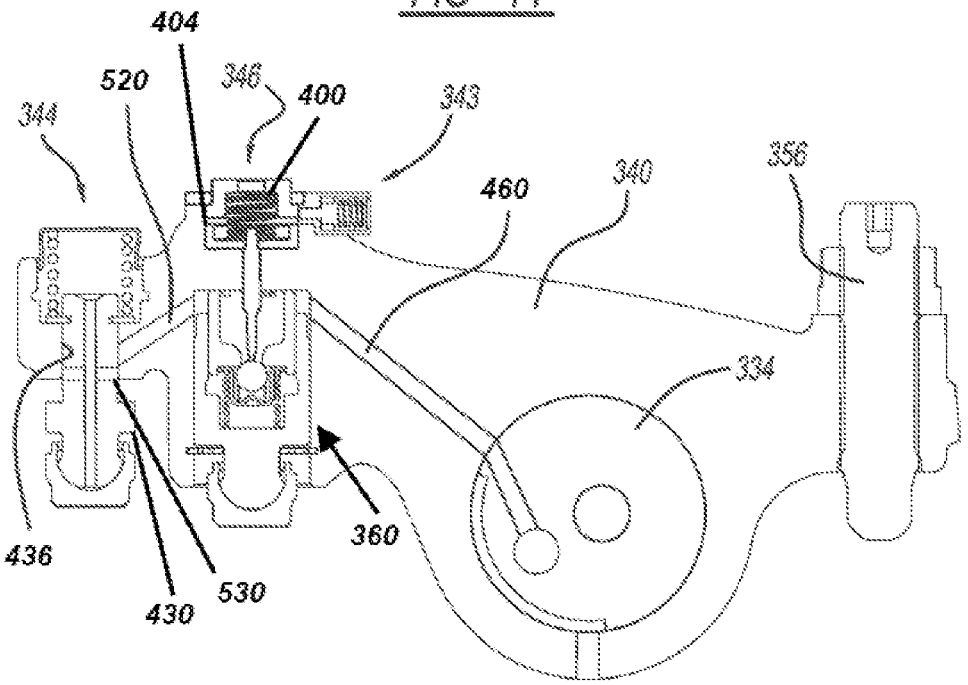
FIG. 15 a schematic illustration of the exhaust valve rocker arm assembly of FIG. 14 illustrating a discharge channel constructed in accordance to an alternate example of the present disclosure.

Turning now to FIGS. 14 and 15, a rocker arm 340 constructed in accordance to additional features will be described. The rocker arm 340 can include similar components as described above and increased by 300. In general, the rocker arm 340 can include an actuation pressurized oil supply passage 360 that connects an oil supply carried from a rocker shaft 334 to bore 404 that houses the needle 400. A pressure relief valve assembly 343 can be configured on the rocker arm 340 for relieving pressure from the bore 404. In one example, the pressure relief valve assembly 343 can be configured similarly to the pressure relief valve 43 described above. The rocker arm 340 can also include a pressurized oil supply passage 460 and a discharge passage 520. The pressurized oil supply passage 460 communicates oil from the rocker shaft 334 to the plunger assembly 360 of the HLA assembly 346. The discharge passage 520 discharges oil from the plunger assembly 360 and out of the bore 436 that receives the spigot assembly 344. In one example, the oil can be communicated through the pass-through channel 530 defined in the spigot 430 and ultimately through the bore 436. As with the pressure relief valve assembly 43 described above, the configuration shown in FIGS. 14 and 15 allows the plunger assembly of the HLA assembly to collapse without causing any return oil pressure against the engine pump.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

What is claimed is:

1. An exhaust valve rocker arm assembly operable in a combustion engine mode and an engine braking mode, the exhaust valve rocker arm assembly comprising:

a rocker shaft that defines a pressurized oil supply conduit;

a rocker arm configured to receive the rocker shaft and configured to rotate around the rocker shaft, the rocker arm including a rocker arm oil supply passage defined therein;

a valve bridge configured to engage a first exhaust valve at a spherical elephant foot and a second exhaust valve at a cylindrical elephant foot;

a hydraulic lash adjuster assembly disposed on the rocker arm and including a first plunger body movable between a first position and a second position, wherein in the first position, the first plunger body extends rigidly for cooperative engagement with the valve bridge, the hydraulic lash adjuster assembly including an actuator configured to selectively release pressure in the hydraulic lash adjuster assembly; and a pressure relief valve assembly disposed on the rocker arm and configured to selectively release oil from the hydraulic lash adjuster assembly, wherein, in the engine braking mode, pressurized oil is communicated through the pressurized oil supply conduit, through the rocker arm oil supply passage, and against the actuator, such that the first plunger body occupies the first position and acts on the valve bridge during rotation of the rocker arm to a first angle, opening the first exhaust valve a predetermined distance while the second exhaust valve remains closed.

2. The exhaust valve rocker arm assembly of claim 1, wherein the pressure relief valve assembly includes a pressure relief valve biasing member, a plunger, and a support ring.

3. The exhaust valve rocker arm assembly of claim 1, further comprising:

a check valve disposed on the rocker arm and including the actuator, wherein the actuator further includes a needle comprising a longitudinal pin portion and a disk portion.

4. The exhaust valve rocker arm assembly of claim 3, further comprising:

an oil discharge circuit configured to selectively depressurize oil under the disk portion of the needle.

5. The exhaust valve rocker arm assembly of claim 4, further comprising:

a spigot disposed on the rocker arm, wherein, in the engine braking mode, subsequent to the opening of the first exhaust valve the predetermined distance, further rotation of the rocker arm causes the spigot to move the valve bridge and open the second exhaust valve while further opening the first exhaust valve.

6. The exhaust valve rocker arm assembly of claim 5, wherein the oil discharge circuit is collectively defined by a first connecting passage and an outlet passage defined in the rocker arm and a pass-through channel defined in the spigot.

7. The exhaust valve rocker arm assembly of claim 6, wherein the first connecting passage connects a bore defined in the rocker arm that receives the disk portion with a spigot receiving passage that receives the spigot.

8. The exhaust valve rocker arm assembly of claim 7, wherein the spigot is configured to translate relative to the rocker arm along the spigot receiving passage, and wherein a predetermined rotation of the rocker arm will align the first connecting passage, the pass-through channel, and the outlet passage, and depressurize oil from under the disk portion of the needle.

9. The exhaust valve rocker assembly of claim 3, wherein the hydraulic lash adjuster assembly further includes a second plunger body that is at least partially received by the first plunger body, and wherein the second plunger body defines a valve seat.

10. The exhaust valve rocker assembly of claim 9, wherein the check valve is disposed between the first and second plunger bodies, wherein the check valve further includes a check ball configured to selectively seat against the valve seat on the second plunger body.

* * * * *